US008016394B2

(12) United States Patent
Yamamoto

(10) Patent No.: US 8,016,394 B2
(45) Date of Patent: Sep. 13, 2011

(54) LIQUID DROPLET EJECTION HEAD AND LIQUID DROPLET EJECTION APPARATUS

(75) Inventor: Takatoshi Yamamoto, Suwa (JP)

(73) Assignee: Seiko Epson Corporation (JP)

( * ) Notice: Subject to any disclaimer, the term of this patent is extended or adjusted under 35 U.S.C. 154(b) by 310 days.

(21) Appl. No.: 12/331,479

(22) Filed: Dec. 10, 2008

(65) Prior Publication Data

US 2009/0147051 A1 Jun. 11, 2009

(30) Foreign Application Priority Data

Dec. 11, 2007 (JP) ..... 2007-320246

(51) Int. Cl.
*B41J 2/045* (2006.01)

(52) U.S. Cl. ..... 347/71

(58) Field of Classification Search ..... 347/40, 347/43, 70, 71, 64, 65, 47, 67, 68
See application file for complete search history.

(56) References Cited

U.S. PATENT DOCUMENTS

| | | | | |
|---|---|---|---|---|
| 5,302,671 | A | 4/1994 | Cifuentes et al. | |
| 5,517,225 | A | 5/1996 | Miyazawa et al. | |
| 5,630,274 | A | 5/1997 | Miyazawa et al. | |
| 5,764,257 | A | 6/1998 | Miyazawa et al. | |
| 6,286,942 | B1 | 9/2001 | Miyazawa et al. | |
| 6,382,780 | B1 | 5/2002 | Watanabe et al. | |
| 7,479,729 | B2 * | 1/2009 | Sugahara et al. | 310/365 |
| 7,585,066 | B2 * | 9/2009 | Silverbrook | 347/93 |
| 7,673,975 | B2 * | 3/2010 | Hashizume et al. | 347/71 |
| 2006/0189767 | A1 | 8/2006 | Bhagwagar et al. | |

FOREIGN PATENT DOCUMENTS

| | | |
|---|---|---|
| JP | 63-202455 | 8/1988 |
| JP | 05-220956 | 8/1993 |
| JP | 06-306347 | 11/1994 |
| JP | H06-306347 | 11/1994 |
| JP | 06-336012 | 12/1994 |
| JP | 7053871 | 2/1995 |
| JP | 08-025629 | 1/1996 |
| JP | 11-188873 | 7/1999 |
| JP | 2000-296615 | 10/2000 |
| JP | 2002-187269 | 7/2002 |
| JP | 2002-302591 | 10/2002 |
| JP | 2003-238770 | 8/2003 |
| JP | 2003-313516 | 11/2003 |
| JP | 2006-520838 | 9/2006 |
| JP | 2006-341619 | 12/2006 |
| JP | 2007-15238 | 1/2007 |
| JP | 2007-62082 | 3/2007 |
| JP | 2007-191629 | 8/2007 |

* cited by examiner

*Primary Examiner* — Lamson D Nguyen
(74) *Attorney, Agent, or Firm* — Harness, Dickey & Pierce, P.L.C.

(57) ABSTRACT

A liquid droplet ejection head includes: a substrate having first and second through-holes for reserving and supplying ejection liquid; a nozzle plate on one substrate surface and covering the first and second through-holes, a sealing plate on the other substrate surface and covering the first through-holes; a driver driving the liquid droplet ejection head to eject the ejection liquid from the nozzle plate; a first bonded portion bonding the substrate to the nozzle plate; and a second bonded portion bonding the substrate to the sealing plate, the first and/or second bonded portion including a bonding film formed by drying a liquid coating formed of a liquid containing a silicone material composed of silicone compounds, and the bonding film bonding the substrate to the nozzle plate and/or the sealing plate due to a bonding property developed in the bonding film by applying energy thereto.

21 Claims, 9 Drawing Sheets

LIQUID DROPLET EJECTION HEAD AND LIQUID DROPLET EJECTION APPARATUS

CROSS-REFERENCE TO RELATED APPLICATION

This application claims a priority to Japanese Patent Application No. 2007-320246 filed on Dec. 11, 2007 which is hereby expressly incorporated by reference herein in its entirety.

BACKGROUND

1. Technical Field

The present invention relates to a liquid droplet ejection head and a liquid droplet ejection apparatus, and more particularly, to a liquid droplet ejection head and a liquid droplet ejection apparatus provided with such a liquid droplet ejection head.

2. Related Art

In a liquid droplet ejection apparatus such as an ink jet printer, a liquid droplet ejection head is provided for ejecting liquid droplets. It is known to public that such a liquid droplet ejection head is provided with ink chambers (cavities) which store an ink therein and are communicated with nozzles for ejecting the ink in the form of the liquid droplets, and piezoelectric elements which deform wall surfaces defining the ink chambers.

When such a liquid droplet ejection head is driven, a part of the ink chambers (a vibration plate) is deformed by expanding and contracting the piezoelectric elements. By doing so, volumes of the ink chambers are changed, so that the liquid droplets of the ink are ejected from the nozzles.

In the meantime, such a liquid droplet ejection head is produced by bonding a nozzle plate in which the nozzles are formed and a substrate in which through-holes that serve as the ink chambers are formed using an adhesive agent.

However, when the adhesive agent is supplied between the nozzle plate and the substrate, it is difficult to strictly control a supply amount of the adhesive agent. Therefore, it is impossible to uniform the supply amount of the adhesive agent, which results in forming an uneven distance between the nozzle plate and the substrate. In the thus produced liquid droplet ejection head, a volume of each ink chamber becomes ununiform.

Further, a distance between the nozzle plate of the liquid droplet ejection head and a print medium such as a print sheet becomes uneven. Furthermore, there is a possibility that the adhesive agent is run out from a bonded portion (between the nozzle plate and the substrate). These problems cause decrease of dimensional accuracy of the liquid droplet ejection head and quality of prints printed by the ink jet printer.

Additionally, the adhesive agent is exposed to an ink stored in the ink chambers for a long period of time. In this case, the adhesive agent is alterated or deteriorated by organic components contained in the ink. For these reasons, there are possibilities that a liquid-tight property of the ink chambers is lowered and components contained in the adhesive agent are dissolved in the ink.

On the other hand, it is known that respective parts constituting a liquid droplet ejection head can be bonded by a solid bonding method. The solid bonding method is a method in which these parts are directly bonded to each other without use of an adhesive layer constituted of an adhesive agent. Examples of such a solid bonding method include a diffusion bonding method, a silicon direct bonding method, an anodic bonding method and the like (see JP-A-2007-62082).

However, the solid bonding method has the following problems: (A) constituent materials to be bonded are limited to specific kinds, (B) a heat treatment using a high temperature (e.g., about 700 to 800° C.) must be carried out in a bonding process, (C) an ambient atmosphere in the bonding process is limited to a reduced atmosphere, (D) it is difficult to obtain a state that the parts of the liquid droplet ejection head are partially bonded together, and the like.

SUMMARY

Accordingly, it is an object of the present invention to provide a liquid droplet ejection head having superior dimensional accuracy, superior chemical resistance and high reliability and being capable of printing in high quality for a long period of time. Further, it is also an object of the present invention to provide a liquid droplet ejection apparatus provided with such a liquid droplet ejection head and therefore being capable of providing high reliability.

A first aspect of the present invention is directed to a liquid droplet ejection head. The liquid droplet ejection head comprises: a substrate having first through-holes that serve as ejection liquid reservoir chambers for reserving an ejection liquid and a second through-hole that serves as an ejection liquid supply chamber for supplying the ejection liquid to the ejection liquid reservoir chambers, the substrate having one surface and the other surface opposite to the one surface; a nozzle plate having nozzles that ejects the ejection liquid in the form of liquid droplets, the nozzle plate provided on a side of the one surface of the substrate so as to cover the first through-holes and the second through-hole of the substrate; a sealing plate provided on a side of the other surface of the substrate so as to cover the first through-holes of the substrate; a driving means that drives the liquid droplet ejection head to eject the ejection liquid from the nozzles; a first bonded portion through which the substrate and the nozzle plate are bonded together; and a second bonded portion through which the substrate and the sealing plate are bonded together.

In this liquid droplet ejection head, at least one of the first and second bonded portions includes a bonding film formed by drying a liquid coating formed of a liquid material containing a silicone material composed of silicone compounds, and the bonding film bonds the substrate and at least one of the nozzle plate and the sealing plate together due to a bonding property developed in the bonding film by applying energy thereto.

The bonding film can have an uniform thickness and excellent chemical resistance. This makes it possible to obtain a liquid droplet ejection head having superior dimensional accuracy, superior chemical resistance and high reliability and being capable of printing in high quality for a long period of time.

In the above liquid droplet ejection head, it is preferred that a part of the at least one of the bonded portions is provisionally formed from an adhesive agent and the other part of the bonded portion is formed from the bonding film.

Such a liquid droplet ejection head can be produced easily and effectively.

In the above liquid droplet ejection head, it is preferred that the first and second bonded portions are formed by the steps of: provisionally bonding the substrate and the nozzle plate together along edge portions thereof using the adhesive agent so as to form a gap between the substrate and the nozzle plate, and the substrate and the sealing plate together along edge portions thereof using the adhesive agent so as to form a gap between the substrate and the sealing plate, respectively; supplying the liquid material into the first through-holes and the second through-hole covered by the nozzle plate and the sealing plate so that the liquid material is filled into the gaps to obtain the liquid coatings within the gaps; and drying the liquid coatings to obtain the bonding films, wherein one of the bonding films bonds the substrate and the nozzle plate together and the other bonding film bonds the substrate and the sealing plate together due to the bonding property developed in each of the bonding films by applying the energy thereto.

In this case, the gaps are automatically filled with the liquid material based on a capillary phenomenon. This makes it possible to easily form the liquid coatings of the liquid material within the gaps so that the bonding films can be obtained. Further, the substrate, the nozzle plate and the sealing plate are provisionally bonded together along the edge portions thereof using the adhesive agent. Therefore, it is possible to easily produce a liquid droplet ejection head.

In addition, since the edge portions of the substrate, the nozzle plate and the sealing plate (that is, portions that do not contact with the ejection liquid) are bonded (fixed) together using the adhesive agent, and portions thereof other than the edge portions (that is, portions that directly contact with the ejection liquid) are bonded together using the bonding films, the thus produced liquid droplet ejection head can have high durability.

In the above liquid droplet ejection head, it is preferred that each of the silicone compounds has a polydimethylsiloxane chemical structure as a main chemical structure thereof.

Such silicone compounds can be relatively easily available at a low price. Further, such silicone compounds can be preferably used as a major component of the silicone material because methyl groups of the silicone compounds are easily removed from their chemical structures by applying the energy to the bonding film containing the silicone compounds, so that the bonding property is reliably developed in the bonding film.

In the above liquid droplet ejection head, it is preferred that each of the silicone compounds has at least one silanol group.

In this case, when drying the liquid coating to transform it into the bonding film, hydroxyl groups included in the silanol groups of the adjacent silicone compounds are bonded together. Therefore, the thus formed bonding film can have more excellent film strength.

In the above liquid droplet ejection head, it is preferred that an average thickness of the bonding film is in the range of 10 to 10,000 nm.

By setting the average thickness of the bonding film to the above range, it is possible to prevent dimensional accuracy of a bonded body obtained by bonding the substrate and at least one of the nozzle plate and the sealing plate together from being significantly lowered, thereby enabling to more firmly bond them together.

Further, in this case, the bonding film can have a certain degree of elasticity. Therefore, when the substrate and the nozzle plate are bonded together or the substrate and the sealing plate are bonded together, even if particles or the like adhere (exist) on a surface of the nozzle plate or the sealing plate on which the bonding film is formed, the bonding film can be bonded to the surface reliably.

As a result, it is possible to reliably prevent occurrence of peeling in a bonding interface therebetween due to the existence of the particles.

In the above liquid droplet ejection head, it is preferred that at least a portion of each of the substrate, the nozzle plate and the sealing plate which makes contact with the bonding film is composed of a silicon material, a metal material or a glass material as a major component thereof.

The portion of each of the substrate, the nozzle plate and the sealing plate composed of such materials is covered with an oxide film. In the oxide film, hydroxyl groups exist in a surface thereof. Therefore, by using the substrate, the nozzle plate and the sealing plate each covered with such an oxide film, it is possible to improve the bonding strength between each of them and the bonding film without subjecting the portion thereof to a surface treatment.

In the above liquid droplet ejection head, it is preferred that a surface of each of the substrate, the nozzle plate and the sealing plate which makes contact with the bonding film has been, in advance, subjected to a surface treatment for improving bonding strength between each of them and the bonding film.

This also makes it possible to more improve the bonding strength between each of the substrate, the nozzle plate and the sealing plate and the bonding film.

In the above liquid droplet ejection head, it is preferred that the surface treatment is a plasma treatment or an ultraviolet ray irradiation treatment.

Use of the plasma treatment or the ultraviolet ray irradiation treatment makes it possible to particularly optimize the surface of each of the substrate, the nozzle plate and the sealing plate.

In the above liquid droplet ejection head, it is preferred that the application of the energy is performed by a method in which an energy beam is irradiated on the bonding film.

This makes it possible to apply the energy to the bonding film relatively easily and efficiently.

In the above liquid droplet ejection head, it is preferred that the energy beam is an ultraviolet ray having a wavelength of 126 to 300 nm.

Use of the ultraviolet ray having such a wavelength makes it possible to optimize an amount of the energy to be applied to the bonding film. As a result, it is possible to prevent excessive breakage of the molecular bonds of the silicone compounds contained in the bonding film as the major component thereof, and to selectively break the molecular bonds of the silicone compounds present in the vicinity of the surface of the bonding film.

This also makes it possible for the bonding film to develop the bonding property, while preventing a property thereof such as a mechanical property or a chemical property from being lowered.

In the above liquid droplet ejection head, it is preferred that the application of the energy is performed in an air atmosphere.

By doing so, it becomes unnecessary to spend a labor hour and a cost for controlling the ambient atmosphere. This also makes it possible to easily perform the application of the energy.

In the above liquid droplet ejection head, it is preferred that after the substrate and at least one of the nozzle plate and the sealing plate are bonded together through the at least one of the bonded portions, the bonding film is subjected to a treatment for improving bonding strength therebetween.

This also makes it possible to further improve the bonding strength between the substrate and the nozzle plate through the first bonded portion including the bonding film and/or the bonding strength between the substrate and the sealing plate through the second bonded portion including the bonding film.

In the above liquid droplet ejection head, it is preferred that the treatment for improving bonding strength is performed by at least one method selected from the group comprising a method in which the bonding film is heated and a method in which a compressive force is applied to the bonding film.

This also makes it possible to further improve the bonding strength between each of the substrate, the nozzle plate and the sealing plate and the bonding film with ease.

In the above liquid droplet ejection head, it is preferred that the sealing plate is formed from a laminated body including a plurality of layers, and two adjacent layers are bonded together through a bonding film having the same composition as that of the bonding film.

This makes it possible to improve dimensional accuracy of the laminated body, eventually, to improve dimensional accuracy of the liquid droplet ejection head.

In the above liquid droplet ejection head, it is preferred that the driving means is a vibration means provided on an opposite side of the sealing plate from the substrate, the vibration means that vibrates the sealing plate, and the vibration means and the sealing plate are bonded together through a bonding film having the same composition as that of the bonding film.

This makes it possible to convert deformation or strain occurring to the vibration means to displacement of the sealing plate, which reliably causes volume change of each of the ejection liquid reservoir chambers.

In the above liquid droplet ejection head, it is preferred that the vibration means comprises piezoelectric elements.

This makes it possible to easily control a degree of deflection which would be generated in the sealing plate. Therefore, it is possible to easily adjust sizes of the liquid droplets of the ejection liquid.

It is preferred that the above liquid droplet ejection head further comprises a case head provided on an opposite side of the sealing plate from the substrate, wherein the sealing plate and the case head are bonded together through a bonding film having the same composition as that of the bonding film.

By doing so, it is possible to further increase bonding strength between the sealing plate and the case head. As a result, it is possible to reliably reinforce the sealing plate by the case head. This makes it possible to reliably prevent deformation, strain or warpage of each of the sealing plate, the substrate and the nozzle plate from occurring.

It is preferred that the above liquid droplet ejection head is adapted to be used for ejecting a liquid material having the same composition as that of the liquid material as the ejection liquid.

The bonding film included in the bonded portion contains the silicone material having excellent chemical resistance as the major component thereof. Therefore, even in the case where the liquid material containing a solvent (a dispersion medium) which alterates or deteriorates a resin material is ejected, the bonded portion is difficult to be alterated or deteriorated. Therefore, the liquid droplet ejection head can exhibit excellent durability for a long period of time.

In the above liquid droplet ejection head, it is preferred that the liquid material to be ejected from the nozzles contains at least one of toluene and xylene.

Both the toluene and the xylene have excellent resolvability to the silicone material. Use of these solvents makes it possible to obtain a homogeneous liquid material in which the silicone material is uniformly dissolved. However, these solvents have high erosive properties with respect to a resin material.

Further, since both the toluene and the xylene have superior volatilities at normal temperature and pressure, they can be easily vaporized for a short period of time in a drying step.

The bonded portion is also difficult to be alterated or deteriorated by both the toluene and the xylene. Therefore, the liquid droplet ejection head of the present invention can be preferably used for stably storing and ejecting such a liquid material containing the at least one of the toluene and the xylene.

A second aspect of the present invention is directed to a liquid droplet ejection apparatus. The liquid droplet ejection apparatus is provided with the above liquid droplet ejection head.

Such a liquid droplet ejection apparatus can have high reliability.

DESCRIPTION OF EXEMPLARY EMBODIMENTS

Hereinbelow, a liquid droplet ejection head and a liquid droplet ejection apparatus according to the present invention will be described in detail with reference to preferred embodiments shown in the accompanying drawings.

Ink jet Type Recording Head

First Embodiment

First, a description will be made on a first embodiment of an ink jet type recording head in which a liquid droplet ejection head according to the present invention is used.

Figure 1:
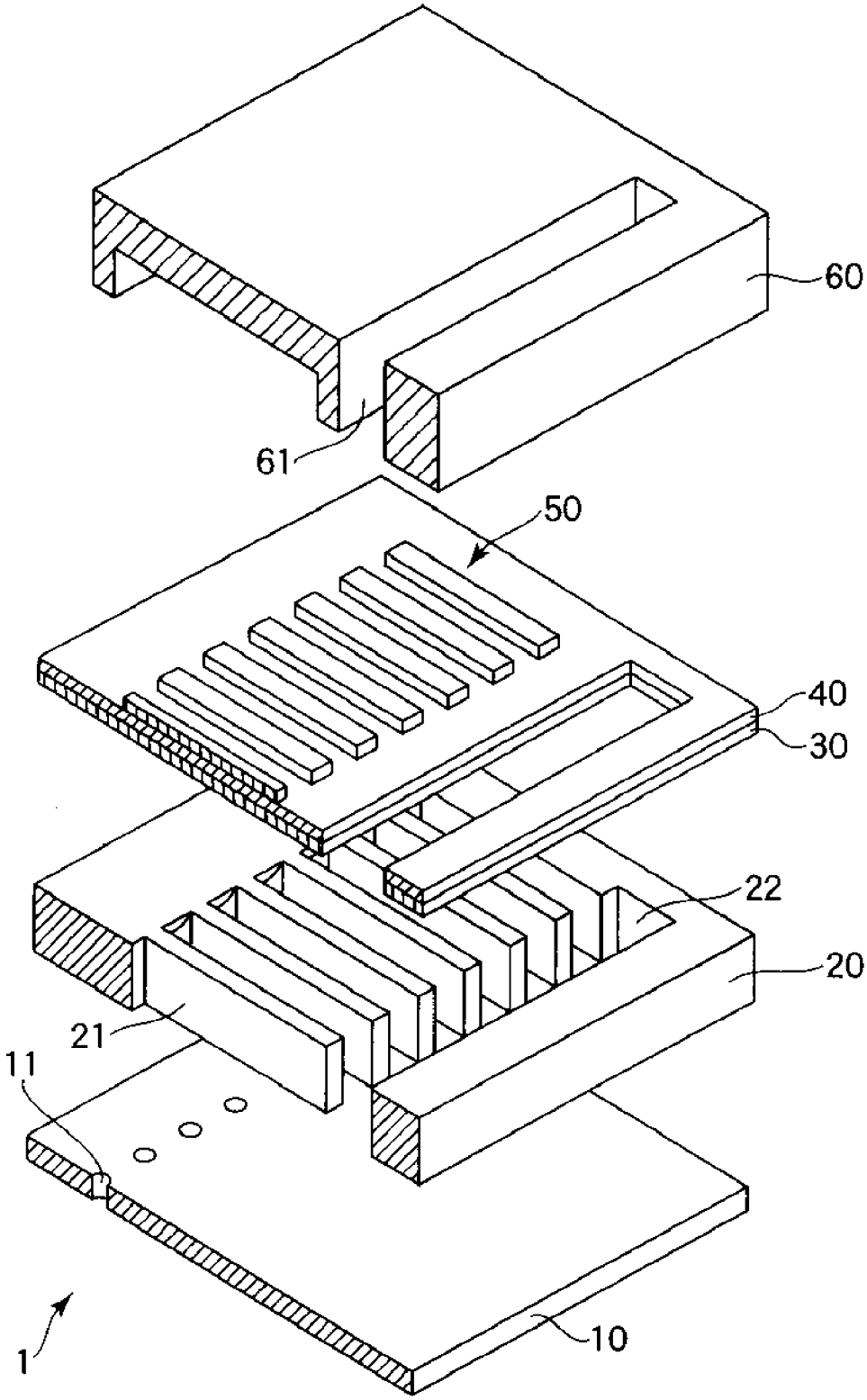
FIG. 1 is an exploded perspective view showing a first embodiment of an ink jet type recording head in which a liquid droplet ejection head according to the present invention is used.
Figure 2:
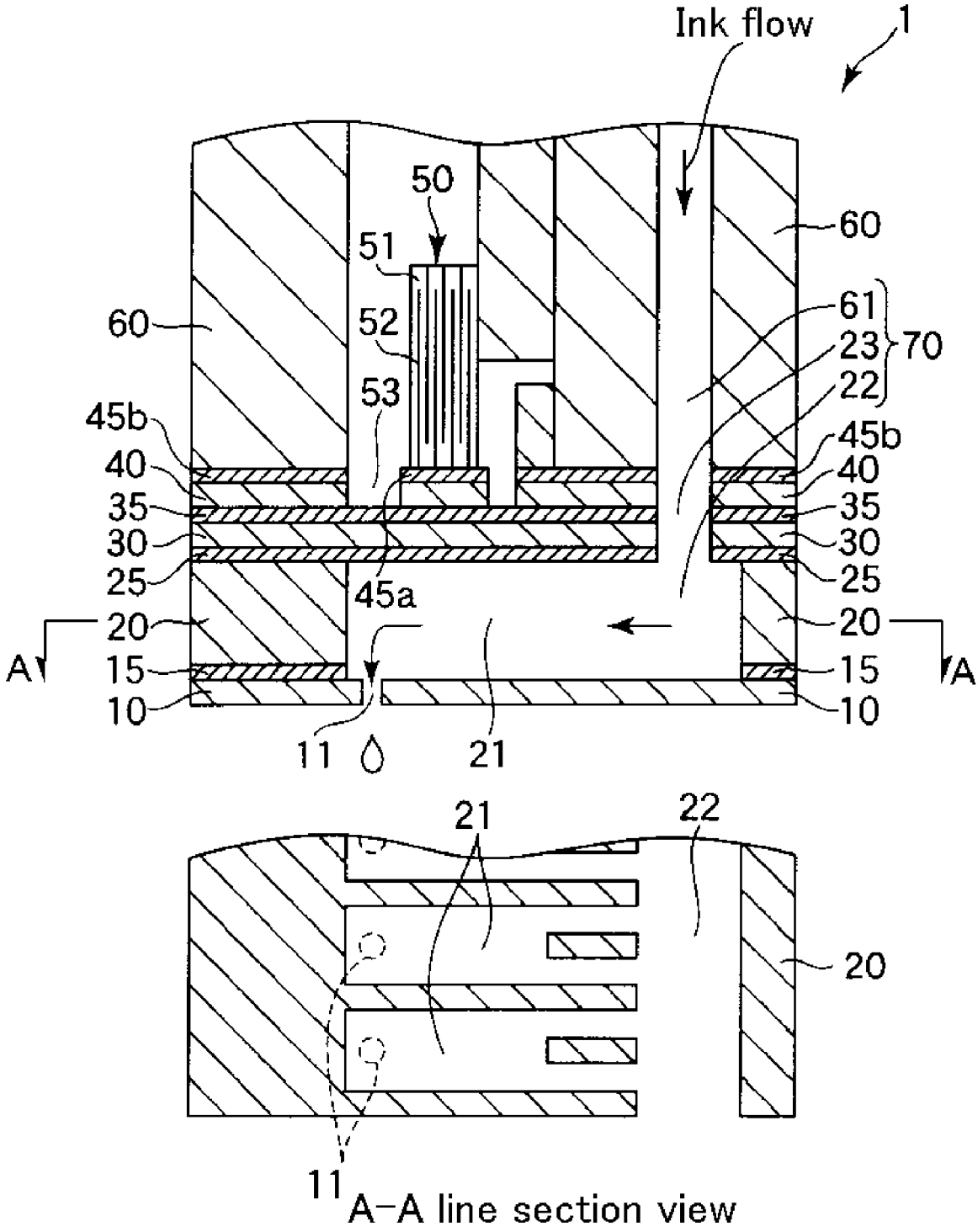
FIG. 2 is a section view showing the ink jet type recording head shown in FIG. 1.

FIG. 1 is an exploded perspective view showing the first embodiment of the ink jet type recording head in which the liquid droplet ejection head according to the present invention is used. FIG. 2 is a section view showing the ink jet type recording head shown in FIG. 1.

Figure 3:
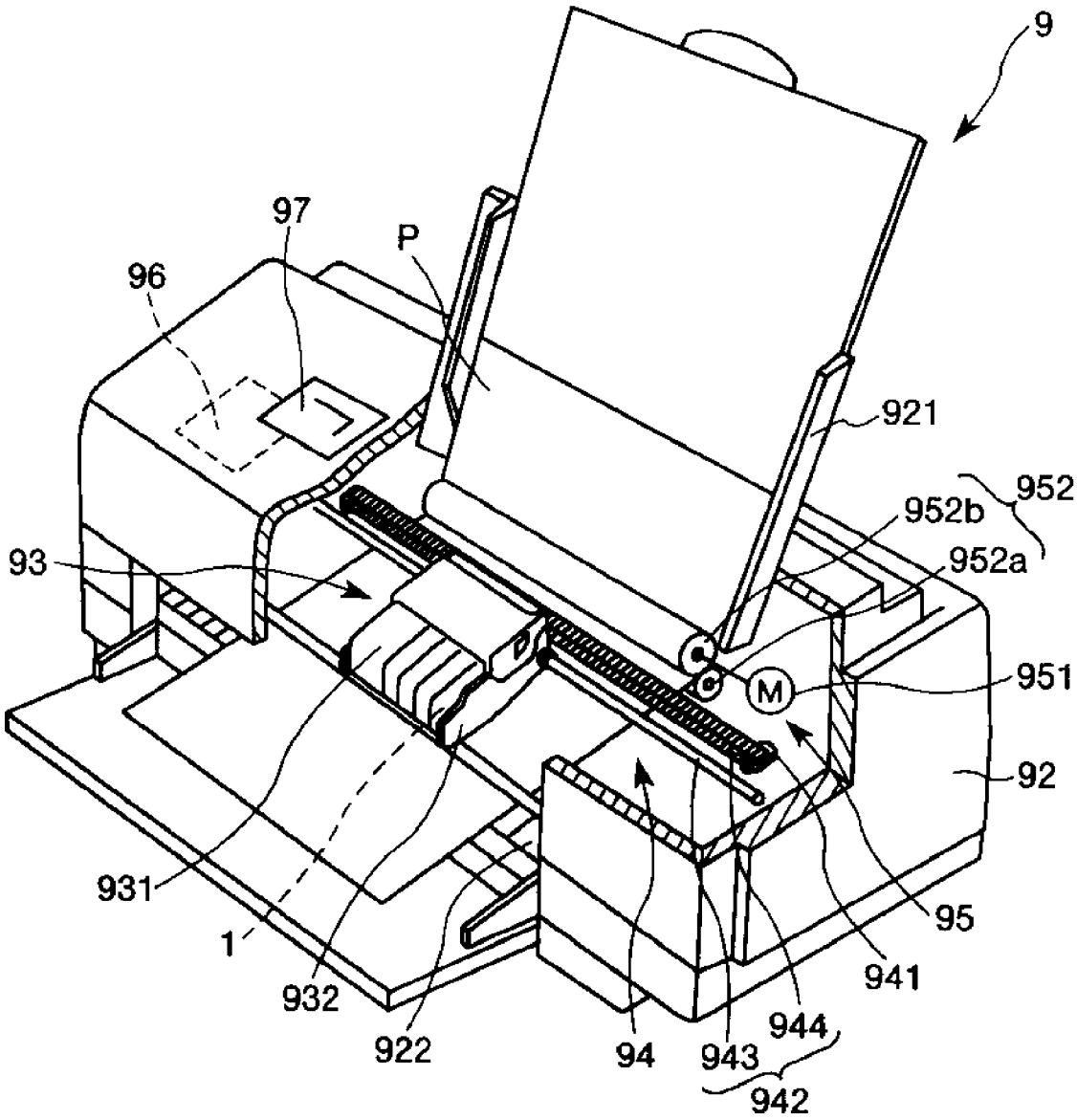
FIG. 3 is a schematic view showing one embodiment of an ink jet printer provided with the ink jet type recording head shown in FIGS. 1 and 2.

FIG. 3 is a schematic view showing one embodiment of an ink jet printer provided with the ink jet type recording head shown in FIGS. 1 and 2. In the following description, the upper side in each of FIGS. 1 to 3 will be referred to as "upper" and the lower side thereof will be referred to as "lower" for convenience of explanation.

The ink jet type recording head 1 (hereinafter, simply referred to as "head 1") shown in FIG. 1 is mounted to an ink jet printer (the liquid droplet ejection apparatus of the present invention) 9 shown in FIG. 3.

The ink jet printer 9 shown in FIG. 3 includes a printer body 92, a tray 921 provided in an upper rear portion of the printer body 92 for holding recording paper sheets P, a paper discharging port 922 provided in a lower front portion of the printer body 92 for discharging the recording paper sheets P therethrough, and an operation panel 97 provided on an upper surface of the printer body 92.

The operation panel 97 includes a display portion (not shown) formed from, e.g., a liquid crystal display, an organic EL display, an LED lamp or the like for displaying an error message and the like and an operation portion (not shown) formed from various kinds of switches.

Within the printer body 92, there are provided a printing device (a printing means) 94 having a reciprocating head unit 93, a paper sheet feeding device (a paper sheet feeding means) 95 for feeding the recording paper sheets P into the printing device 94 one by one and a control unit (a control means) 96 for controlling the printing device 94 and the paper sheet feeding device 95.

Under control of the control unit 96, the paper sheet feeding device 95 feeds the recording paper sheets P one by one in an intermittent manner. The recording paper sheets P pass near a lower portion of the head unit 93. At this time, the head unit 93 makes reciprocating movement in a direction generally perpendicular to a feeding direction of the recording paper sheets P, so that the recording paper sheets P are printed.

In other words, the reciprocating movement of the head unit 93 and the intermittent feeding of the recording paper sheets P, respectively, act as primary scanning and secondary scanning of an ink jet type printing operation so that it is performed.

The printing device 94 includes the head unit 93, a carriage motor 941 serving as a driving power source of the head unit 93 and a reciprocating mechanism 942 for reciprocating the head unit 93 by rotations of the carriage motor 941.

The head unit 93 includes the head 1 having a plurality of nozzles 11 formed in a lower portion thereof, an ink cartridge 931 for supplying an ink to the head 1 and a carriage 932 carrying the head 1 and the ink cartridge 931.

Full color printing becomes available by using a cartridge of the type filled with the ink of each of four colors, i.e., yellow, cyan, magenta and black as the ink cartridge 931.

The reciprocating mechanism 942 includes a carriage guide shaft 943 whose opposite ends are supported on a frame (not shown) and a timing belt 944 extending parallel to the carriage guide shaft 943.

The carriage 932 is reciprocatingly supported by the carriage guide shaft 943 and fixedly secured to a portion of the timing belt 944.

If the timing belt 944 wound around a pulley is caused to run in forward and reverse directions by operating the carriage motor 941, the head unit 93 makes reciprocating movement along the carriage guide shaft 943. During this reciprocating movement, an appropriate amount of the ink is ejected from the head 1 so that the recording paper sheets P are printed.

The paper sheet feeding device 95 includes a paper sheet feeding motor 951 serving as a driving power source thereof and a pair of paper sheet feeding rollers 952 rotated by means of the paper sheet feeding motor 951.

The paper sheet feeding rollers 952 include a driven roller 952*a* and a driving roller 952*b*, both of which face toward each other in a vertical direction, with a paper sheet feeding path (the recording paper sheets P) remained therebetween. The driving roller 952*b* is connected to the paper sheet feeding motor 951.

Thus, the paper sheet feeding rollers 952 are able to feed the plurality of recording paper sheets P, which are held in the tray 921, toward the printing device 94 one by one. In place of the tray 921, it may be possible to employ a construction that can removably hold a paper sheet feeding cassette containing the recording paper sheets P.

The control unit 96 is designed to perform printing by controlling the printing device 94 and the paper sheet feeding device 95 based on printing data inputted from a host computer such as a personal computer or a digital camera.

Although not shown in the drawings, the control unit 96 is mainly comprised of a memory that stores a control program for controlling the respective parts and the like, a driving circuit for driving the printing device 94 (the carriage motor 941), a driving circuit for driving the paper sheet feeding device 95 (the paper sheet feeding motor 951), a communication circuit for receiving the printing data from the host computer, and a CPU electrically connected to these parts for performing various kinds of control with respect to the respective parts.

Electrically connected to the CPU are a variety of sensors capable of detecting, e.g., a remaining amount of the ink contained in the ink cartridge 931 and a position of the head unit 93.

The control unit 96 receives the printing data through the communication circuit and then stores them in the memory. The CPU processes these printing data and outputs driving signals to the respective driving circuits, based on the data thus processed and data inputted from the variety of sensors. Responsive to these signals, the printing device 94 and the paper sheet feeding device 95 come into operation so that the recording paper sheets P are printed.

Hereinafter, the head 1 will be described in detail with reference to FIGS. 1 and 2.

As shown in FIGS. 1 and 2, the head 1 includes a nozzle plate 10, a substrate 20 for forming ejection liquid reservoir chambers (hereinafter, simply referred to as "substrate 20"), which is provided on the nozzle plate 10 through a bonding film (a first bonded portion) 15, and a sealing sheet 30 provided on the substrate 20 through a bonding film (a second bonded portion) 25.

Further, the head 1 also includes a vibration plate 40 provided on the sealing sheet 30 through a bonding film (a third bonded portion) 35, piezoelectric elements (a vibration or driving means) 50 each provided on a part of a surface of the vibration plate 40 through a bonding film (a fourth bonded portion) 45*a* and a case head 60 provided on the other part of the surface of the vibration plate 40 through a bonding film (a fifth bonding film) 45*b* so as to cover the piezoelectric elements 50.

In this regard, it is to be noted that a sealing plate is formed from a laminated body composed of the sealing sheet 30 and the vibration plate 40 in this embodiment. The head 1 configures a piezo-jet type head.

First through-holes that serve as a plurality of ejection liquid reservoir chambers (pressure chambers) 21 for reserving the ink as the ejection liquid (hereinafter, simply referred to as "reservoir chambers 21") and a second through-hole that serves as an ejection liquid supply chamber 22 for supplying the ink to the reservoir chambers 21 (hereinafter, simply referred to as "supply chamber 22"), with which the plurality of the reservoir chambers 21 are communicated, are formed in the substrate 20.

That is to say, the reservoir chambers 21 are formed from the first through-holes, the nozzle plate 10 and the bonding film 25 (the sealing sheet 30), and the supply chamber 22 is formed from the second through-hole and the nozzle plate 10.

As shown in FIGS. 1 and 2, the reservoir chambers 21 and the supply chamber 22 are in a substantially rectangular shape in a plane view of the substrate 20, respectively. In the plane view of the substrate 20, a width (a short side) of each reservoir chamber 21 is smaller than that of the supply chamber 22.

Further, in the plane view of the substrate 20, the reservoir chambers 21 are arranged in a perpendicular direction with respect to a length direction (a long side) of the supply chamber 22. The reservoir chambers 21 and the supply chamber 22 are formed in a comb-like shape as a whole in the plane view of the substrate 20.

In this regard, it is to be noted that the supply chamber 22 may be a trapezoidal shape, a triangular shape and a bale-like shape (a capsule shape) in addition to the rectangular shape like this embodiment in the plane view of the substrate 20.

Examples of a constituent material of the substrate 20 include: a silicon material such as monocrystalline silicon, polycrystalline silicon and amorphous silicon; a metal material such as stainless steel, titanium and aluminum; a glass material such as quartz glass, glass silicate, alkali glass silicate, soda-lime glass, potash-lime glass, lead (alkali) glass, barium glass and borosilicate glass; a ceramic material such as alumina, zirconia, ferrite, silicon nitride, aluminium nitride, boron nitride, titanium nitride, silicon carbide, boron carbide, titanium carbide and tungsten carbide; a carbon material such as graphite; a resin material such as polyolefin (e.g., polyethylene, polypropylene, an ethylene-propylene copolymer and an ethylene-vinyl acetate copolymer (EVA)), cyclic polyolefin, denatured polyolefin, polyvinyl chloride, polyvinylidene chloride, polystyrene, polyamide, polyimide, polyamide-imide, polycarbonate, poly-(4-methylpentene-1), an ionomer, acrylic resin, polymethyl methacrylate, an acrylonitrile-butadiene-styrene copolymer (ABS resin), an acrylonitrile-styrene copolymer (AS resin), a butadiene-styrene copolymer, polyoxymethylene, polyvinyl alcohol (PVA), an ethylene-vinyl alcohol copolymer (EVOH), polyester (e.g., polyethylene terephthalate (PET), polyethylene naphthalate, polybutylene terephthalate (PBT) and polycyclohexane terephthalate (PCT)), polyether, polyether ketone (PEK), polyether ether ketone (PEEK), polyether imide, polyacetal (POM), polyphenylene oxide, denatured polyphenylene oxide, a denatured polyohenylene ether resin (PBO), polysulfone, polyether sulfone, polyphenylene sulfide (PPS), polyarylate, a liquid crystal polymer (e.g., aromatic polyester), a fluoro resin (e.g., polytetrafluoroethylene and polyfluorovinylidene), a thermoplastic elastomer (e.g., a styrene-based elastomer, a polyolefin-based elastomer, a polyvinylchloride-based elastomer, a polyurethane-based elastomer, a polyester-based elastomer, a polyamide-based elastomer, a polybutadiene-based elastomer, a trans-polyisoprene-based elastomer, a fluororubber-based elastomer and a chlorinated polyethylene-based elastomer), an epoxy resin, a phenolic resin, an urea resin, a melamine resin, an aramid resin, an unsaturated polyester, a silicone resin, polyurethane, or a copolymer, a blended body and a polymer alloy each having at least one of these materials as a major component thereof; a complex material containing any one kind of the above materials or two or more kinds of the above materials; and the like.

Further, the constituent material of the substrate 20 may be a material obtained by subjecting the above materials to a treatment such as an oxidation treatment (an oxide film formation treatment), a plating treatment, a passivation treatment and a nitriding treatment.

Among these materials mentioned above, the constituent material of the substrate 20 is preferably the silicon material or the stainless steel. Such materials have superior chemical resistance. Therefore, even if these materials are exposed to the ink for a long period of time, it is possible to reliably prevent the substrate 20 from being alterated or deteriorated.

Further, since these materials also have superior workability, it is also possible to obtain a substrate 20 having high dimensional accuracy. For these reasons, volumes of the reservoir chambers 21 and the supply chamber 22 become uniform, respectively. Consequently, it is possible to obtain a head 1 which is capable of printing in high quality.

Further, the supply chamber 22 is communicated with an ink supply path 61 which is provided in the case head 60 described later and serves as a part of a reservoir 70 which functions as a common ink chamber for supplying the ink to the reservoir chambers 21.

Furthermore, surfaces of parts of the head 1 each facing the reservoir chambers 21 and the supply chamber 22 (that is, an inner surface of the substrate 20, an upper surface of the nozzle plate 10 and the like) may have been, in advance, subjected to a hydrophilic treatment. This makes it possible to prevent bubbles from mixing in the ink reserved (supplied) into the reservoir chambers 21 and the supply chamber 22.

The nozzle plate 10 is provided on a side of one surface of the substrate 20 so as to cover the first through-holes and the second through-hole of the substrate 20. Specifically, as shown in FIG. 2, the upper surface of the nozzle plate 10 is bonded to a lower surface of the substrate 20 (that is, an opposite surface of the substrate 20 from the sealing sheet 30) through the bonding film 15.

The liquid droplet ejection head 1 according to the present invention is characterized by the bonding film (the first bonded portion) 15 itself and a method of bonding the substrate 20 and the nozzle plate 10 together through the bonding film 15.

This bonding film 15 is formed by drying a liquid coating formed of a liquid material containing a silicone material composed of silicone compounds.

When energy is applied to the bonding film 15, a part of molecular bonds of the silicone compounds present in the vicinity of a surface (facing the nozzle plate 10) of the bonding film 15 are broken. As a result, the surface of the bonding film 15 is activated due to breakage of the molecular bonds.

Namely, a bonding property with respect to the nozzle plate 10 is developed in the vicinity of the surface of the bonding film 15. By using the bonding property of the bonding film 15, the substrate 20 and the nozzle plate 10 are bonded together therethrough.

In this regard, it is to be noted that the bonding film 15 will be described later in more detail.

Nozzles 11 are formed in the nozzle plate 10 so as to correspond to positions of the reservoir chambers 21, respectively. The ink can be ejected from the nozzles 11 in the form of liquid droplets by pushing the ink reserved in the reservoir chambers 21. As shown in FIG. 2, a lower end of the reservoir chambers 21 and the supply chamber 22 is defined by the upper surface of the nozzle plate 10.

In other words, the reservoir chambers 21 are partitioned (provided) by the upper surface of the nozzle plate 10, the inner surface of the substrate 20 by which the first through-holes are defined and a lower surface of bonding film 25 which is bonded to the sealing sheet 30. Further, the supply chamber 22 is partitioned (provided) by the inner surface of the substrate 20 by which the second through-hole is defined and the upper surface of the nozzle plate 10.

Examples of a constituent material of such a nozzle plate 10 include the silicon material, the metal material, the glass material, the ceramic material, the carbon material, the resin material, the complex material containing any one kind of the above materials or two or more kinds of the above materials; and the like as described above.

Among these materials mentioned above, the constituent material of the nozzle plate 10 is preferably the silicone material or the stainless steel. Such materials have superior chemical resistance. Therefore, even if these materials are exposed to the ink for a long period of time, it is possible to reliably prevent the nozzle plate 10 from being alterated or deteriorated.

Further, since these materials also have superior workability, it is also possible to obtain a nozzle plate 10 having high dimensional accuracy. For these reasons, it is possible to obtain a head 1 having high reliability.

A coefficient of linear expansion of the constituent material of the nozzle plate 10 is preferably in the range of about 2.5 to 4.5 ($\times 10^{-6}$/° C.) at a temperature of 300° C. or lower. Further, a thickness of the nozzle plate 10 is not particularly limited to a specific value, but is preferably in the range of about 0.01 to 1 mm.

A liquid repellency film (not shown) is provided on a lower surface of the nozzle plate 10, if needed. This makes it possible to prevent the liquid droplets of the ink (ink droplets) from being ejected in unintended directions from the nozzles 11.

Examples of a constituent material of such a liquid repellency film include a coupling agent containing at least one functional group having liquid repellency, a resin material having liquid repellency, and the like.

Examples of such a coupling agent to be used in the constituent material of the liquid repellency film include a silane-based coupling agent, a titanium-based coupling agent, an aluminum-based coupling agent, a zirconium-based coupling agent, an organophosphate-based coupling agent, a silyl-peroxide-based coupling agent and the like.

Examples of the functional group having the liquid repellency include a fluoroalkyl group, an alkyl group, a vinyl group, an epoxy group, a styryl group, a methacryloxy group and the like.

Examples of the resin material having the liquid repellency to be used in the constituent material of the liquid repellency film include a fluoro-based resin such as polytetrafluoroethylene (PTFE), a tetrafluoroethylene-perfluoroalkylvinylether copolymer (PFA), an ethylene-tetrafluoroethylene copolymer (ETFE), a perfluoroethylene-propene copolymer (FEP), an ethylene-chlorotrifluoroethylene copolymer (ECTFE) and the like.

The sealing sheet 30 is provided on a side of the other surface of the substrate 20 so as to cover the first through-holes of the substrate 20. Specifically, as shown in FIG. 2, the sealing sheet 30 is bonded to an upper surface of the substrate 20 through the bonding film 25.

An upper end of the reservoir chambers 21 is defined by the lower surface of the bonding film 25. In other words, the reservoir chambers 21 are partitioned by the upper surface of the nozzle plate 10, the inner surface of the substrate 20 by which the first through-holes are defined and the lower surface of the bonding film 25.

By reliably bonding the sealing sheet 30 and the substrate 20 together through the bonding film 25, liquid-tight properties of the reservoir chambers 21 and the supply chamber 22 are ensured in the first and second bonded portions.

Examples of a constituent material of the sealing sheet 30 include the silicon material, the metal material, the glass material, the ceramic material, the carbon material, the resin material, the complex material containing any one kind of the above materials or two or more kinds of the above materials, and the like as described above.

Among these materials mentioned above, the constituent material of the sealing sheet 30 is preferably the resin material such as the polyphenylenesulfide (PPS) and the aramid resin, the silicon material or the stainless steel. Such materials have superior chemical resistance. Therefore, even if these materials are exposed to the ink for a long period of time, it is possible to reliably prevent the sealing sheet 30 from being alterated or deteriorated. For these reasons, it is possible to reserve the ink in the reservoir chambers 21 and the supply chamber 22 for a long period of time.

Such a bonding film 25 through which the sealing sheet 30 and the substrate 20 are bonded together has the same bonding property (bonding function) as that of the above mentioned bonding film 15. Namely, this bonding film 25 is also formed by drying the liquid coating formed of the liquid material containing the silicone material composed of the silicone compounds.

When energy is applied to the bonding film 25, a part of molecular bonds of the silicone compounds present in the vicinity of a surface (facing the sealing sheet 30) of the bonding film 25 are broken. As a result, the surface of the bonding film 25 is activated due to breakage of the molecular bonds.

Namely, a bonding property with respect to the sealing sheet 30 is developed in the vicinity of the surface of the bonding film 25. By using the bonding property of the bonding film 25, the substrate 20 and the sealing sheet 30 are bonded together therethrough.

In this regard, it is to be noted that the bonding film 25 will be described later in more detail together with the bonding film 15.

A vibration plate 40 is bonded to an upper surface of the sealing sheet 30 through a bonding film 35.

Examples of a constituent material of the vibration plate 40 include the silicon material, the metal material, the glass material, the ceramic material, the carbon material, the resin material, the complex material containing any one kind of the above materials or two or more kinds of the above materials, and the like as described above.

By reliably bonding the vibration plate 40 and the sealing sheet 30 together through the bonding film 35, deformation or strain occurring to the piezoelectric elements 50 are reliably converted to displacement of the sealing sheet 30, namely, volume change of each of the reservoir chambers 21.

Among these materials mentioned above, the constituent material of the vibration plate 40 is preferably the silicon material or the stainless steel. Such materials are capable of being elastically deformed at a high speed. As a result, the ink can be ejected from the nozzles 11 in high accuracy.

Such a bonding film 35, through which the sealing sheet 30 and the vibration plate 40 are bonded together, may be formed of any material as long as the vibration plate 40 can be bonded to the sealing sheet 30.

Examples of the constituent material of the bonding film 35 include: an adhesive agent such as an epoxy-based adhesive agent, a silicone-based adhesive agent, an urethane-based adhesive agent; a brazing material such as a solder; and the like, which are appropriately selected depending on the constituent material of each of the vibration plate 40 and the sealing sheet 30.

The bonding film 35 is not necessarily provided between the vibration plate 40 and the sealing sheet 30, and may be omitted. In this case, the vibration plate 40 can be bonded to the sealing sheet 30 using a direct bonding method such as a fusion (weld) method or a solid bonding method (e.g. a silicon direct bonding method or an anodic bonding method).

In this embodiment, the bonding film 35 has the same bonding property (bonding function) as that of the above mentioned bonding film 15. Namely, this bonding film 35 is also formed by drying the liquid coating formed of the liquid material containing the silicone material composed of the silicone compounds.

When energy is applied to the bonding film 35, a part of molecular bonds of the silicone compounds present in the vicinity of a surface (facing the vibration plate 40) of the bonding film 35 are broken. As a result, the surface of the bonding film 35 is activated due to breakage of the molecular bonds.

Namely, a bonding property with respect to the vibration plate 40 is developed in the vicinity of the surface of the bonding film 35. By using the bonding property of the bonding film 35, the sealing sheet 30 and the vibration plate 40 are bonded together therethrough.

In this regard, it is to be noted that the bonding film 35 will be described later in more detail together with the bonding film 15 and the bonding film 25.

Further, in this embodiment, a sealing plate is constituted from a laminated body formed by laminating the vibration plate 40 and the sealing sheet 30 together. The sealing plate may be constituted from a single layer or a laminated body which is formed by laminating three or more layers together.

In the case where the sealing plate is constituted from the laminated body which is formed by laminating the three or more layers together, it is preferred that at least adjacent two layers among the layers of the laminated body are bonded together by the bonding film 35. This makes it possible to improve dimensional accuracy of the laminated body, as a result of which the head 1 can have high dimensional accuracy.

The piezoelectric elements (the vibration or driving means) 50 are bonded to a part of an upper surface of the vibration plate 40 (near a center portion of the upper surface of the vibration plate 40 in FIG. 2) through the bonding films 45*a*.

Each of the piezoelectric elements 50 is composed from a laminated body including piezoelectric layers 51 constituted of a piezoelectric material and electrical films 52 for applying a voltage to the piezoelectric layers 51.

In such piezoelectric elements 50, when the voltage is applied to the piezoelectric layers 51 through the electrical films 52, deformation or strain of the piezoelectric layers 51 occurs depending on the applied voltage due to an inverse piezoelectric effect. The deformation or strain gives deflection (vibration) to the vibration plate 40 and the sealing sheet 30, thereby changing the volumes of the reservoir chambers 21.

By reliably bonding the piezoelectric elements 50 and the vibration plate 40 together through the bonding films 45*a*, the deformation or strain occurring to the piezoelectric elements 50 (the piezoelectric layers 51) is reliably converted to displacements of the sealing sheet 30 and the vibration plate 40, which can cause the volume change of each of the reservoir chambers 21.

A direction of laminating the piezoelectric layers 51 and the electrical films 52 together is not particularly limited but may be a parallel direction or a perpendicular direction to the vibration plate 40.

In the case where the direction of laminating the piezoelectric layers 51 and the electrical films 52 together is the parallel direction to the vibration plate 40, namely, the piezoelectric elements 50 are formed by laminating the piezoelectric layers 51 and the electrical films 52 together in such a direction, each of the piezoelectric elements 50 is referred to as "MLP (Multi Layer Piezo)".

If the MLPs are used as the piezoelectric elements 50, it is possible to deflect the vibration plate 40 in a large manner. Therefore, there is an advantage that an amount of the ink to be ejected can be adjusted within a wide range in the head 1 which is driven by the MLPs.

A surface of each of the piezoelectric elements 50 adjacent to (making contact with) the bonding film 45*a* is a surface in which the piezoelectric layers 51 are exposed (side surfaces of the piezoelectric layers 51), a surface in which the electrical films 52 are exposed (side surfaces of the electrical films 52), or a surface in which both the piezoelectric layers 51 and the electrical films 52 are exposed (both of the side surfaces), though it is different by arrangement of the piezoelectric elements 50.

Examples of a constituent material of the piezoelectric layers 51 of the piezoelectric elements 50 include barium titanate, lead zirconate, lead titanate zirconate, zinc oxide, aluminum nitride, lithium tantalite, lithium niobate, crystal and the like.

Examples of a constituent material of the electrical films 52 of the piezoelectric elements 50 include various kinds of metal materials such as Fe, Ni, Co, Zn, Pt, Au, Ag, Cu, Pd, Al, W, Ti, Mo and an alloy containing these materials, and the like.

Such bonding films 45*a*, through which the vibration plate 40 and the piezoelectric elements 50 are bonded together, may be formed of any material as long as the vibration plate 40 can be bonded to the piezoelectric elements 50.

Examples of the constituent material of each of the bonding films 45*a* include: an adhesive agent such as an epoxy-based adhesive agent, a silicone-based adhesive agent, an urethane-based adhesive agent; a brazing material such as a solder; and the like, which are appropriately selected depending on the constituent material of each of the vibration plate 40 and the piezoelectric elements 50.

The bonding films 45*a* are not necessarily provided between the vibration plate 40 and the piezoelectric elements 50, and may be omitted. In this case, the piezoelectric elements 50 are bonded to the vibration plate 40 using a direct bonding method such as a fusion (weld) method or a solid bonding method (e.g. a silicon direct bonding method or an anodic bonding method).

In this embodiment, such bonding films 45*a* through which the vibration plate 40 and the piezoelectric elements 50 are bonded together have the same bonding property (bonding function) as that of the above mentioned bonding film 15. Namely, these bonding films 45*a* are also formed by drying the liquid coatings each formed of the liquid material containing the silicone material composed of the silicone compounds.

When energy is applied to the bonding films 45*a*, a part of molecular bonds of the silicone compounds present in the vicinity of surfaces (facing the piezoelectric elements 50) of the bonding films 45*a* are broken. As a result, the surfaces of the bonding films 45*a* are activated due to breakage of the molecular bonds.

Namely, a bonding property with respect to the piezoelectric elements 50 is developed in the vicinity of the surfaces of the bonding films 45*a*. By using the bonding property of each of the bonding films 45*a*, the vibration plate 40 and the piezoelectric elements 50 are bonded together therethrough.

In this regard, it is to be noted that the bonding films 45*a* will be described later in more detail together with the bonding film 15, the bonding film 25 and the bonding film 35.

The vibration plate 40 described above has concave portions 53 each formed in an annular shape so as to surround a region to which each of the piezoelectric elements 50 is bonded (laminated). That is to say, in the vibration plate 40, the regions to which the respective piezoelectric elements 50 are bonded are isolated through the annular-shaped concave portions 53 so that each of the regions exists in the form of an island shape.

In this regard, it is to be noted that the respective bonding films 45*a* are provided (laminated) on upper surfaces of the island-shaped regions inside the annular-shaped concave portions 53 of the vibration plate 40.

Further, the electrical films 52 of the piezoelectric elements 50 are electrically connected to a driving IC (not shown). This makes it possible to control a movement of the piezoelectric elements 50 by the driving IC.

Furthermore, a case head 60 is bonded to an upper surface of a region of the vibration plate 40 through a bonding film 45*b*. By reliably bonding the vibration plate 40 and the case head 60 together through the bonding film 45*b*, it is possible to reinforce a so-called cavity part composed from a laminated body including the nozzle plate 10, the substrate 20, the sealing sheet 30 and the vibration plate 40. This makes it possible to reliably suppress deformation, strain or warpage of the cavity part from occurring.

Examples of a constituent material of the case head 60 include the silicon material, the metal material, the glass material, the ceramic material, the carbon material, the resin material, the complex material containing any one kind of the above materials or two or more kinds of the above materials, and the like as described above.

Among these materials mentioned above, the constituent material of the case head 60 is preferably the resin material such as the polyphenylenesulfide (PPS), the denatured polyphenylene ether resin (e.g. "xyron" which is a registered mark) or the stainless steel. This is because these materials have sufficient rigidity. Therefore, these materials can be preferably used as the constituent material of the case head 60 which supports (or reinforces) the cavity part.

Such a bonding film 45*b*, through which the vibration plate 40 and the case head 60 are bonded together, may be formed of any material as long as the vibration plate 40 can be bonded to the case head 60.

Examples of the constituent material of the bonding film 45*b* include: an adhesive agent such as an epoxy-based adhesive agent, a silicone-based adhesive agent, an urethane-based adhesive agent; a brazing material such as a solder; and the like, which are appropriately selected depending on the constituent material of each of the vibration plate 40 and the case head 60.

The bonding film 45*b* is not necessarily provided between the vibration plate 40 and the case head 60, and may be omitted. In this case, the vibration plate 40 can be bonded to the case head 60 using a direct bonding method such as a fusion (weld) method or a solid bonding method (e.g. a silicon direct bonding method or an anodic bonding method).

In this embodiment, the bonding film 45*b* has the same bonding property (bonding function) as that of the above mentioned bonding film 15. Namely, this bonding film 45*b* is also formed by drying the liquid coating formed of the liquid material containing the silicone material composed of the silicone compounds.

When energy is applied to the bonding film 45*b*, a part of molecular bonds of the silicone compounds present in the vicinity of a surface (facing the case head 60) of the bonding film 45*b* are broken. As a result, the surface of the bonding film 45*b* is activated due to breakage of the molecular bonds.

Namely, a bonding property with respect to the case head 60 is developed in the vicinity of the surface of the bonding film 45*b*. By using the bonding property of the bonding film 45*b*, the vibration plate 40 and the case head 60 are bonded together therethrough.

In this regard, it is to be noted that the bonding film 45*b* will be described later in more detail together with the bonding film 15, the bonding film 25, the bonding film 35, the bonding film 45*a*.

A through-hole 23 is formed so as to pass through the bonding film 25, the sealing sheet 30, the bonding film 35, the vibration plate 40 and the bonding film 45*b* at a region corresponding to the supply chamber 22 (the second through-hole) provided in the substrate 20. The ink supply path 61 provided in the case head 60 is communicated with the supply chamber 22 through the through-hole 23.

In this regard, it is to be noted that the reservoir 70 is composed from the ink supply path 61, the through-hole 23 and the supply chamber 22. The reservoir 70 serves as the common ink chamber from which the ink is supplied to the reservoir chambers 21.

In such a head 1, after the nozzles 11, the reservoir chambers 21 and the reservoir 70 are filled with the ink which has been supplied from an outside ejection liquid supply means (not shown), the piezoelectric elements 50 corresponding to the reservoir chambers 21 are, respectively, moved by a recording signal sent from the driving IC. By doing so, deflection (vibration) occurs to the vibration plate 40 and the sealing sheet 30 due to the inverse piezoelectric effect of the piezoelectric elements 50.

As a result, if the reservoir chambers 21 are constricted, namely, the volumes of the reservoir chambers 21 are reduced, pressures within the reservoir chambers 21 instantaneously become high, thereby the ink contained in the reservoir chambers 21 is pushed (ejected) from the nozzles 11 in the form of the liquid droplets.

In the head 1, by applying the voltage to the piezoelectric elements 50 lying in target printing positions through the driving IC, namely, by sequentially inputting ejection signals from the driving IC to the piezoelectric elements 50 lying in the target printing positions, it is possible to print an arbitrary (desired) letter, figure or the like.

In this regard, the head 1 is not limited to the configuration as described above, and it may be a thermal type head in which a heater is used as the driving means instead of the piezoelectric elements 50 (the vibration means). Such a head 1 can eject the ink from the nozzles 11 in the form of the liquid droplets by heating and boiling the ink using the heater to thereby increase the pressure within the reservoir chambers 21.

Alternative examples of the vibration means include a static actuator and the like. In the case where the vibration means is composed from the piezoelectric elements 50 like this embodiment, it is possible to easily control a degree of deflection which would occur to the vibration plate 40 and the sealing sheet 30. This makes it possible to easily control sizes of the liquid droplets of the ink (the ink droplets).

Further, each of the bonding films 35, 45*a* and 45*b* may not be formed by drying the liquid coating formed of the liquid material containing the silicone material composed of the silicone compounds.

In this case, at least one of the bonding between the sealing sheet 30 and the vibration plate 40, the bonding between the vibration plate 40 and the piezoelectric elements 50, and the bonding between the vibration plate 40 and the case head 60 can be performed using an adhesive agent such as an epoxy-based adhesive agent or an urethane-based adhesive agent, a solid bonding method and the like.

Hereinafter, descriptions will be made on a method of forming the bonding films 15, 25, 35, 45*a* and 45*b*, and a method of producing the ink jet type recording head 1 provided with the bonding films 15, 25, 35, 45*a* and 45*b* formed by the above method.

FIGS. 4A to 4F, 5G to 5I, 6J to 6L, 7M and 7N are views (vertical section views) for describing a method of producing the ink jet type recording head shown in FIGS. 1 and 2 (hereinafter, simply referred to as "head 1"). In the following description, the upper side in each of FIGS. 4A to 4F, 5G to 5I, 6J to 6L, 7M and 7N will be referred to as "upper" and the lower side thereof will be referred to as "lower" for convenience of explanation.

The method of producing the head 1 according to this embodiment includes the following thirteen steps.

Figure 4A:
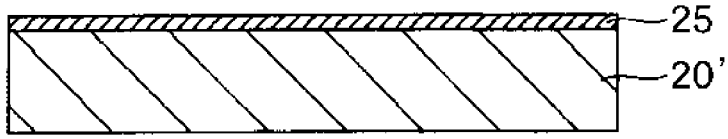
FIGS. 4A to 4F are views (vertical section views) for describing a method of producing the ink jet type recording head shown in FIGS. 1 and 2.

A first step is a step for forming the bonding film 25 on an upper surface of the base material 20' (see FIG. 4A). A second step is a step for bonding the base material 20' and the sealing sheet 30 through the bonding film 25 to thereby obtain a first bonded body (see FIG. 4B).

Figure 4B:
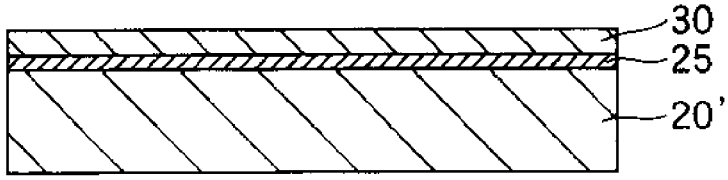
Figure 4C:
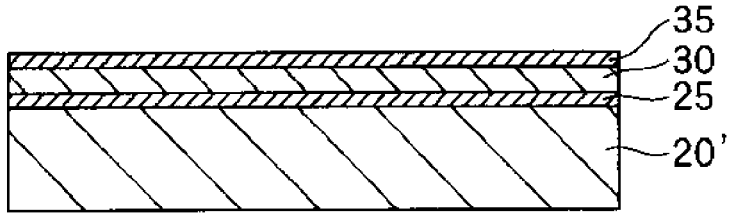

A third step is a step for forming the bonding film 35 on the upper surface of the sealing sheet 30 (see FIG. 4C). A fourth step is a step for bonding the sealing sheet 30 and the vibration plate 40 through the bonding film 35 to thereby obtain a second bonded body (see FIG. 4D).

Figure 4D:
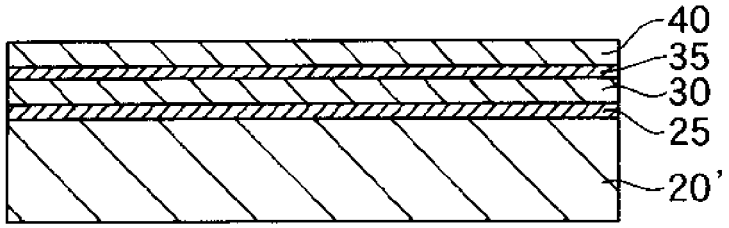
Figure 4E:
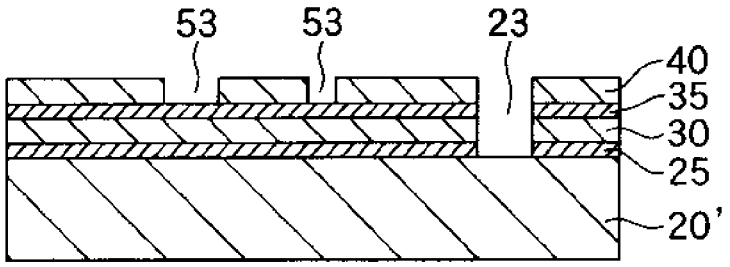

A fifth step is a step for forming a concave portion which will be changed into the through-hole 23 in a partial region of the second bonded body so as to pass through the bonding film 25, the sealing sheet 30, the bonding film 35 and the vibration plate 40 and reach the base material 20' (see FIG. 4E).

A sixth step is a step for forming the concave portions 53 in partial regions of the second bonded body so as to pass through the vibration plate 40 and reach the bonding film 35 (see FIG. 4E).

Figure 4F:
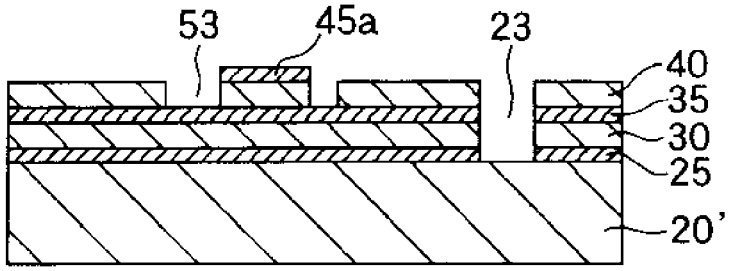

A seventh step is a step for forming the bonding films 45*a* on the upper surfaces of the regions (the island-shaped regions) of the vibration plate 40, wherein each of the regions is surrounded by the concave portion 53 (see FIG. 4F). An eighth step is a step for bonding the vibration plate 40 and the piezoelectric elements 50 through the bonding films 45*a* to thereby obtain a third bonded body (see FIG. 5G).

Figure 5G:
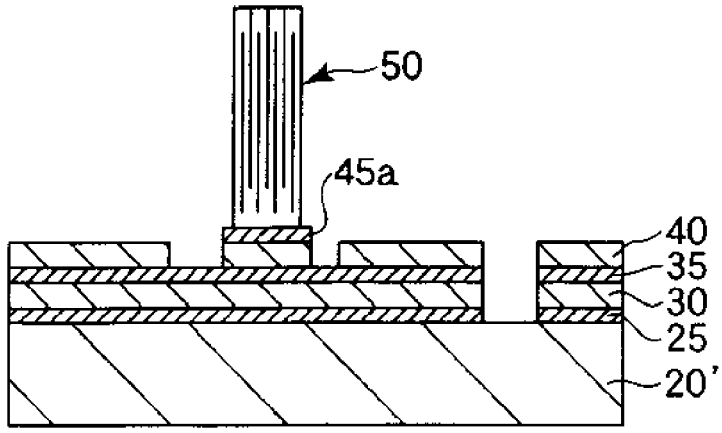
FIGS. 5G to 5I are views (vertical section views continued from FIG. 4F) for describing a method of producing the ink jet type recording head shown in FIGS. 1 and 2.
Figure 5H:
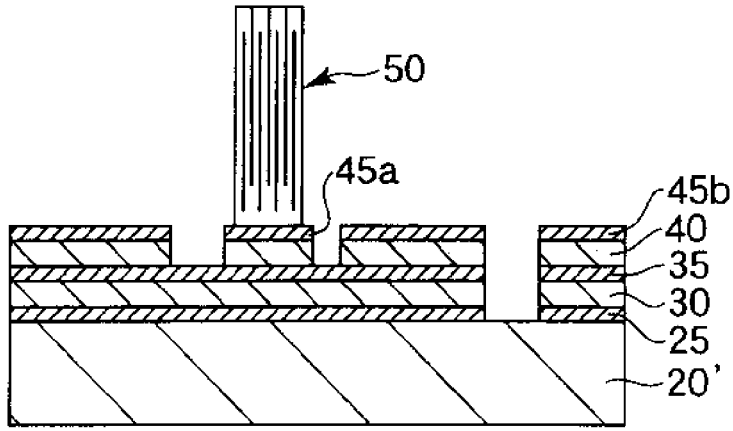

A ninth step is a step for forming the bonding film 45*b* on the upper surface of the region of the vibration plate 40 other than the regions each surrounded by the concave portion 53 (see FIG. 5H). A tenth step is a step for bonding the vibration plate 40 and the case head 60 through the bonding film 45*b* to thereby obtain a fourth bonded body (see FIG. 5I).

Figure 6J:
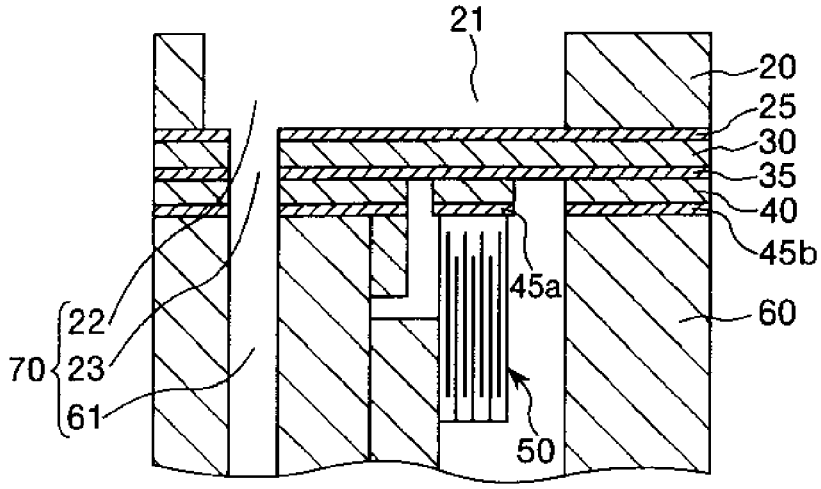
FIGS. 6J to 6L are views (vertical section views continued from FIG. 5I) for describing a method of producing the ink jet type recording head shown in FIGS. 1 and 2.

An eleventh step is a step for forming a substrate 20 by processing the base material 20' (see FIG. 6J).

Figure 6K:
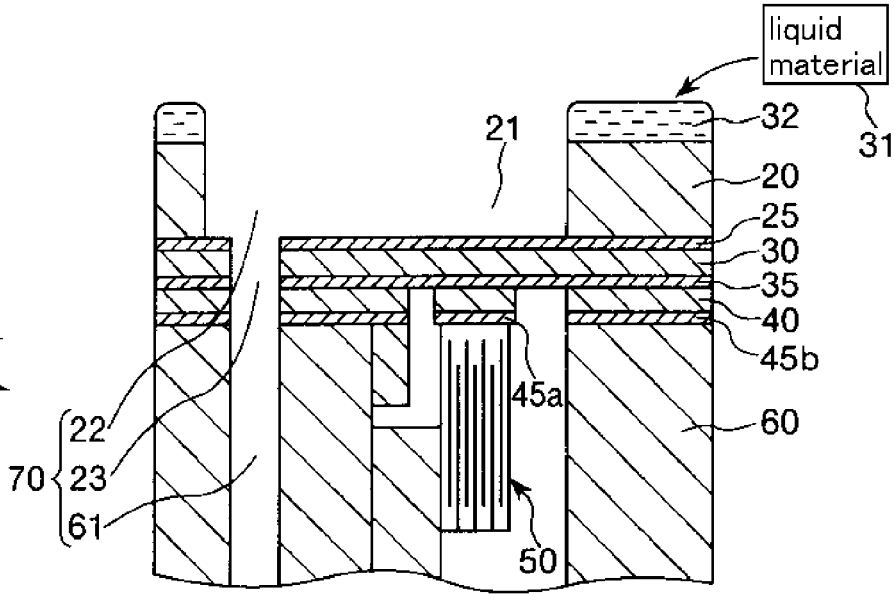

A twelfth step is a step for forming the bonding film 15 on the lower surface of the substrate 20 (that is, the opposite surface of the substrate 20 from the sealing sheet 30) (see FIG. 6K). A thirteenth step is a step for bonding the substrate 20 and the nozzle plate 10 through the bonding film 15 to thereby obtain a fifth bonded body (see FIGS. 6L, 7M and 7N).

Hereinafter, the steps will be described sequentially.

<1> First, the base material 20' is prepared for producing the substrate 20. The base material 20' is processed in the subsequent step described later to obtain the substrate 20.

Next, as shown in FIG. 4A, the bonding film 25 is formed on the upper surface of the base material 20' (that is, this step <1> is the first step). In this regard, it is to be noted that the bonding film 25 can be formed using the same method as employed in the bonding film 15 described later.

<2> Next, the energy is applied to the bonding film 25. By doing so, the bonding property with respect to the sealing sheet 30 is developed in the bonding film 25. In this regard, it is to be noted that the energy can be applied to the bonding film 25 using the same method as employed in the bonding film 15 described later.

<3> Next, the sealing sheet 30 is prepared. Then, the base material 20' and the sealing sheet 30 are laminated together so that the bonding film 25 in which the bonding property has been developed and the sealing sheet 30 make close contact with each other. As a result, as shown in FIG. 4B, the base material 20' and the sealing sheet 30 are bonded together through the bonding film 25 to thereby obtain the first bonded body (that is, these steps <2> and <3> are the second step).

<4> Next, as shown in FIG. 4C, the bonding film 35 is formed on the upper surface of the sealing sheet 30 (that is, this step <4> is the third step). In this regard, it is to be noted that the bonding film 35 can be formed using the same method as employed in the bonding film 15 described later.

<5> Next, the energy is applied to the bonding film 35. By doing so, the bonding property with respect to the vibration plate 40 is developed in the bonding film 35. In this regard, it is to be noted that the energy can be applied to the bonding film 35 using the same method as employed in the bonding film 15 described later.

<6> Next, the vibration plate 40 is prepared. Then, the base material 20' provided with the sealing sheet 30 (that is, the first bonded body) and the vibration plate 40 are laminated together so that the bonding film 35 in which the bonding property has been developed and the vibration plate 40 make close contact with each other. As a result, as shown in FIG. 4D, the vibration plate 40 is bonded to the sealing sheet 30 through the bonding film 35 (these steps <5> and <6> are the fourth step).

In this way, as shown in FIG. 4D, the base material 20', the sealing sheet 30 and the vibration plate 40 are bonded together through the bonding films 25 and 35 to thereby obtain the second bonded body.

<7> Next, as shown in FIG. 4E, the concave portion which will be changed into the through-hole 23 is formed in the partial region of the second bonded body corresponding to the supply chamber 22 to be formed. Further, the concave portions 53 each having an annular shape are formed so as to surround the regions (the island-shaped regions) of the vibration plate 40 on which the piezoelectric elements 50 are to be provided (this step <7> is the sixth and seventh steps).

Examples of a method for forming the concave portion which will be changed into the through-hole 23 and the concave portion 53 include: a physical etching method such as a dry etching method, a reactive ion etching method, a beam etching method or a photo assist etching method; a chemical etching method such as a wet etching method; and the like. These methods may be used singly or in combination of two or more of them.

<8> Next, as shown in FIG. 4F, the bonding films 45*a* are formed on the upper surfaces of the regions of the vibration plate 40 on which the piezoelectric elements 50 are to be provided (this step <8> is the seventh step). In this regard, it is to be noted that the bonding films 45*a* can be formed using the same method as employed in the bonding film 15 described later.

In the case where the bonding films 45*a* are partially (selectively) formed on the upper surfaces of the regions of the vibration plate 40, they may be formed using a mask provided with window portions each having a shape corresponding to the region on which each of the bonding films 45*a* is to be formed.

<9> Next, the energy is applied to the bonding films 45*a*. By doing so, the bonding property with respect to the piezoelectric element 50 is developed in each of the bonding films 45*a*. In this regard, it is to be noted that the energy can be applied to the bonding films 45*a* using the same method as employed in the bonding film 15 described later.

<10> Next, the piezoelectric elements 50 are prepared. Then, the vibration plate 40 (the second bonded body) and the piezoelectric elements 50 are laminated together so that the bonding films 45*a* in each of which the bonding property has been developed and the piezoelectric elements 50 make close contact with each other. As a result, as shown in FIG. 5G, the piezoelectric elements 50 are bonded to the vibration plate 40 through the bonding films 45*a* (these steps <9> and <10> are the eighth step).

In this way, as shown in FIG. 5G, the base material 20', the sealing sheet 30, the vibration plate 40 and the piezoelectric elements 50 are bonded together through the bonding films 25, 35 and 45*a* to thereby obtain the third bonded body.

<11> Next, as shown in FIG. 5H, the bonding film 45*b* is formed on the upper surface of the region of the vibration plate 40 on which the case head 60 is to be provided (this step <11> is the ninth step). In this regard, it is to be noted that the bonding films 45*b* can be formed using the same method as employed in the bonding film 15 described later.

In the case where the bonding films 45*b* is partially (selectively) formed on the upper surface of the region of the vibration plate 40, it may be formed using a mask provided with a window portion having a shape corresponding to the region on which the bonding film 45*b* is to be formed.

<12> Next, the energy is applied to the bonding film 45*b*. By doing so, the bonding property with respect to the case head 60 is developed in the bonding film 45*b*. In this regard, it is to be noted that the energy can be applied to the bonding film 45*b* using the same method as employed in the bonding film 15 described later.

<13> Next, the case head 60 is prepared. Then, the vibration plate 40 (the third bonded body) and the case head 60 are laminated together so that the bonding film 45*b* in which the bonding property has been developed and the case head 60 make close contact with each other. As a result, as shown in FIG. 5I, the case head 60 is bonded to the vibration plate 40 through the bonding film 45*b* (these steps <12> and <13> are the tenth step).

Figure 5I:
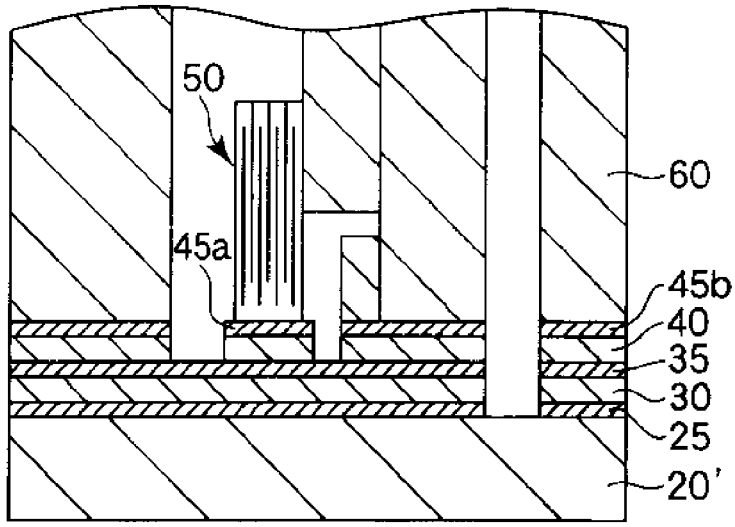

In this way, as shown in FIG. 5I, the base material 20', the sealing sheet 30, the vibration plate 40, the piezoelectric elements 50 and the case head 60 are bonded together through the bonding films 25, 35, 45*a* and 46*b* to thereby obtain the fourth bonded body.

<14> Next, the base material 20' provided with the sealing sheet 30, the vibration plate 40, the piezoelectric elements 50 and the case head 60 (that is, the fourth bonded body) is turn over as shown in FIG. 6J. By processing an opposite surface of the base material 20' from the sealing sheet 30, a concave portion which will be changed into the reservoir chambers 21 and the supply chamber 22 is formed so as to pass through the base material 20' and reach the bonding film 25 (this step <14> is the eleventh step).

In this way, the substrate 20 is obtained by forming the concave portion (the first through-holes and the second through-hole) in the base material 20' (see FIG. 6J). At this time, the concave portion continuously formed through the bonding film 25, the sealing sheet 30, the bonding film 35 and the vibration plate 40 is communicated with the concave portion formed in the substrate 20 to thereby form the through-hole 23.

The base material 20' can be processed using the above mentioned various etching methods. As described above, in this embodiment, the concave portion (the first through-holes and the second through-hole) which will be changed into the reservoir chambers 21 and the supply chamber 22 are formed by processing the base material 20' provided with the sealing sheet 30, the vibration plate 40, the piezoelectric elements 50 and the case head 60.

However, the first through-holes which will be changed into the reservoir chambers 21 and the second through-hole which will be changed into the supply chamber 22 may have been, in advance, formed in the base material 20' at the time of the above step <1> (that is, the first step). In other words, in the above step <1>, the substrate 20 having the first through-holes and the second through-hole may be used instead of the base material 20'.

<15> Next, the nozzle plate 10 is bonded to an opposite surface (an upper surface in each of FIGS. 6J to 6L, 7M and 7N) of the substrate 20 from the sealing sheet 30 so as to cover the concave portion (that is, the first through-holes and the second through-hole).

By doing so, the reservoir chambers 21 and the supply chamber 22 are formed. Further, the supply chamber 22 is communicated with the ink supply path 61 through the through-hole 23, so that the reservoir 70 is formed.

Hereinafter, a description will be made on a method of bonding the substrate 20 and the nozzle plate 10 together in detail.

Here, it is preferred that a bonding surface (the upper surface in each of FIGS. 6J to 6L, 7M and 7N) of the substrate 20 to which the nozzle plate 10 is to be bonded (that is, a surface on which the bonding film 15 is to be formed) is subjected to a surface treatment for improving bonding strength between the substrate 20 and the bonding film 15.

This makes it possible to further improve the bonding strength between the substrate 20 and the bonding film 15, eventually to improve the bonding strength between the substrate 20 and the nozzle plate 10.

Such a surface treatment is not particularly limited to a specific type. Examples of the surface treatment include: a physical surface treatment such as a sputtering treatment or a blast treatment; a chemical surface treatment such as a plasma treatment performed using oxygen plasma and nitrogen plasma, a corona discharge treatment, an etching treatment, an electron beam irradiation treatment, an ultraviolet ray irradiation treatment or an ozone exposure treatment; a treatment performed by combining two or more kinds of these surface treatments; and the like.

By performing such a surface treatment, it is possible to clean and activate a region on which the bonding film 15 is to be formed.

Among these surface treatments, it is possible to use the plasma treatment because the region on which the bonding film 15 is to be formed can be particularly optimized.

In this regard, it is to be noted that in the case where the substrate 20 which is to be subjected to the surface treatment is formed of a resin material (a polymeric material), the corona discharge treatment, the nitrogen plasma treatment and the like are particularly preferably used.

Depending on the constituent material of the substrate 20, the bonding strength of the bonding film 15 to the substrate 20 becomes sufficiently high even if the bonding surface of the substrate 20 is not subjected to the surface treatment described above.

Examples of the constituent material of the substrate 20 with which such an effect is obtained include materials containing various kinds of the metal-based material, various kinds of the silicon-based material, various kinds of the glass-based material and the like as a major component thereof.

The surface of the substrate 20 formed of such materials is covered with an oxide film. In the oxide film, hydroxyl groups exist in a surface thereof. Therefore, by using the substrate 20 covered with such an oxide film, it is possible to improve the bonding strength between the substrate 20 and the bonding film 15 without subjecting the bonding surface thereof to the surface treatment described above.

In this regard, it is to be noted that in this case, the entire of the substrate 20 may not be composed of the above materials, as long as a vicinity of the bonding surface of the substrate 20 at least within the region, on which the bonding film 15 is to be formed, is composed of the above materials.

Furthermore, if the region of the substrate 20, on which the bonding film 15 is to be formed, has the following groups and substances, the bonding strength between the substrate 20 and the bonding film 15 can become sufficiently high even if the region is not subjected to the surface treatment described above.

Examples of such groups and substances include at least one group or substance selected from the group comprising a functional group such as a hydroxyl group, a thiol group, a carboxyl group, an amino group, a nitro group or an imidazole group, a radical, an open circular molecule, an unsaturated bond such as a double bond or a triple bond, halogen such as F, Cl, Br or I, and a peroxide.

It is preferred that one selected from various surface treatment described above is appropriately selectively performed so that the bonding surface having such groups and substances can be obtained.

Further, it is also preferred that instead of the surface treatment, an intermediate layer has been, in advance, provided on at least the region of the bonding surface of the substrate 20 on which the bonding film 15 is to be formed.

This intermediate layer may have any function. Such a function is not particularly limited to a specific kind. Examples of the function include: a function of improving bonding strength of the substrate 20 to the bonding film 15; a cushion property (that is, a buffering function); a function of reducing stress concentration; and the like.

By forming the bonding film 15 on the substrate 20 through such an intermediate layer, it is possible to improve the bonding strength between the substrate 20 and the bonding film 15. As a result, it is possible to obtain a fifth bonded body having high reliability, that is, a head 1 having high reliability.

A constituent material of such an intermediate layer include: a metal-based material such as aluminum or titanium; an oxide-based material such as metal oxide or silicon oxide; a nitride-based material such as metal nitride or silicon nitride; a carbon-based material such as graphite or diamond-like carbon; a self-organization film material such as a silane coupling agent, a thiol-based compound, a metal alkoxide or a metal halide; and the like, and one or more of which may be used independently or in combination.

Among intermediate layers composed of these various materials, use of the intermediate layer composed of the oxide-based material makes it possible to further improve the bonding strength between the substrate 20 and the bonding film 15 through the intermediate layer.

On the other hand, it is preferred that a region of the nozzle plate 10 which is to be made contact with the bonding film 15 has been, in advance, subjected to a surface treatment for improving bonding strength between the region and the bonding film 15. This makes it possible to improve bonding strength between the nozzle plate 10 and the bonding film 15.

As such a surface treatment, the same surface treatment as the above mentioned surface treatment, to which the substrate 20 is subjected can be used.

Further, it is also preferred that a surface layer having a function of improving the bonding strength with respect to the bonding film 15 has been, in advance, provided on at least the region of the nozzle plate 10 with which the bonding film 15 is to be made contact, instead of the surface treatment. This makes it possible to further improve the bonding strength between the nozzle plate 10 and the bonding film 15.

As for a constituent material of such a surface layer, for example, the same material as the constituent material of the intermediate layer formed on the substrate 20 can be used.

It goes without saying that like the substrate 20 or the nozzle plate 10, parts such as the sealing sheet 30, the vibration plate 40, the piezoelectric elements 50 and the case head 60 may be subjected to the above mentioned surface treatment, and the intermediate or surface layer may be provided on these parts. This makes it possible to further improve bonding strength between the respective parts including in the head 1.

<15-1> Next, the liquid material 31 is applied (supplied) onto the upper surface of the substrate 20 provided with the sealing sheet 30, the vibration plate 40, the piezoelectric elements 50 and the case head 60, to thereby form the liquid coating 32 as shown in FIG. 6K.

As a method of supplying the liquid material 31, various kinds of methods such as a liquid droplet ejecting method (an ink jet method), a spin coating method, a screen printing method and the like can be used.

Among these methods, use of the liquid droplet ejecting method makes it possible to selectively supply the liquid material 31 onto a required region, e.g., a region of the upper surface of the substrate 20 on which the bonding film 15 is to be formed.

As described above, the liquid material 31 contains the silicone material composed of the silicone compounds.

Here, "silicone material" means a material composed of silicone compounds (molecules) each having a polyorganosiloxane chemical structure, that is, silicone compounds each having a main chemical structure (a main chain) mainly constituted of organosiloxane repeating units.

Each of the silicone compounds contained in the silicone material may have a branched chemical structure including a main chain and side chains each branched therefrom, a ringed chemical structure in which the main chain forms a ring shape, or a straight chemical structure in which both ends of the main chain are not bonded together.

In each silicone compound having the polyorganosiloxane chemical structure, for example, an organosiloxane repeating unit constituting each end portion of the polyorganosiloxane chemical structure is a repeating unit represented by the following general formula (1), an organosiloxane repeating unit constituting each connecting portion of the polyorganosiloxane chemical structure is a repeating unit represented by the following general formula (2), and an organosiloxane repeating unit constituting each branched portion of the polyorganosiloxane chemical structure is a repeating unit represented by the following general formula (3).

(1)

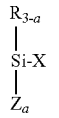

(2)

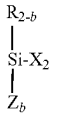

(3)

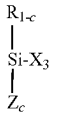

wherein in the general formulas (1) to (3), each of the Rs is independently a substituted hydrocarbon group or an unsubstituted hydrocarbon group, each of the Zs is independently a hydroxyl group or a hydrolysable group, each of the Xs is a siloxane residue, the a is 0 or an integer of 1 to 3, the b is 0 or an integer of 1 to 2, and the c is 0 or 1.

In this regard, the siloxane residue means a substituent group which is bonded to a silicon atom contained in an adjacent repeating unit via an oxygen atom to thereby form a siloxane bond. Specifically, the siloxane residue is a chemical structure of —O—(Si), wherein the Si is the silicon atom contained in the adjacent repeating unit.

In each silicone compound, the polyorganosiloxane chemical structure is preferably the straight chemical structure, that is, a chemical structure constituted of the repeating units each represented by the above general formula (1) and the repeating units each represented by the above general formula (2).

In the case where a silicone material composed of such silicone compounds is used, since in the following step, the silicone compounds are tangled together in the liquid material 31 (the liquid coating 32) so that the bonding film 15 is formed, the thus formed bonding film 15 can have excellent film strength.

Specifically, examples of the silicone compound having such a polyorganosiloxane chemical structure include a silicone compound represented by the following general formula (4).

(4)

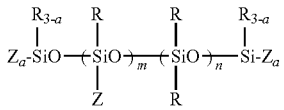

Wherein in the general formula (4), each of the Rs is independently a substituted hydrocarbon group or an unsubstituted hydrocarbon group, each of the Zs is independently a hydroxyl group or a hydrolysable group, the a is 0 or an integer of 1 to 3, the m is 0 or an integer of 1 or more, and the n is 0 or an integer of 1 or more.

In the general formulas (1) to (4), examples of the R (the substituted hydrocarbon group or unsubstituted hydrocarbon group) include: an alkyl group such as a methyl group, an ethyl group or a propyl group; a cycloalkyl group such as a cyclopentyl group or a cyclohexyl group; an aryl group such as a phenyl group, a tolyl group or a biphenylyl group; and an aralkyl group such as a benzyl group or a phenyl ethyl group.

Further, in the above groups, a part of or all hydrogen atoms bonding to carbon atom(s) may be respectively substituted by I) a halogen atom such as a fluorine atom, a chlorine atom or a bromine atom, II) an epoxy group such as a glycidoxy group, III) a (meth)acryloyl group such as an methacryl group, IV) an anionic group such as a carboxyl group or a sulfonyl group, and the like.

Examples of the hydrolysable group include: an alkoxy group such as a methoxy group, an ethoxy group, a propoxy group, a butoxy group; a ketoxime group such as a dimethyl ketoxime group or a methyl ethyl ketoxime group; an acyloxy group such as an acetoxy group; an alkenyloxy group such as an isopropenyloxy group or an isobutenyloxy group; and the like.

Further, in the general formula (4), the m and n represent a degree of polymerization of the polyorganosiloxane chemical structure. The total number of the m and n (that is, m+n) is preferably an integer of about 5 to 10,000, and more preferably an integer of about 50 to 1,000. By setting the degree of the polymerization to the above range, a viscosity of the liquid material 31 can be relatively easily adjusted to a range described below.

Among various kinds of the silicone materials, it is preferable to use a silicone material composed of silicone compounds each having a polydimethylsiloxane chemical structure (that is, a chemical structure represented by the above general formula (4) in which the Rs are the methyl groups) as a main chemical structure thereof. Such silicone compounds can be relatively easily available at a low price.

Further, such silicone compounds can be preferably used as a major component of the silicone material because the methyl groups are easily broken and removed from their chemical structures by applying energy. Therefore, in the case where the bonding film 15 contains such a silicone material, when applying the energy to the bonding film 15 in the subsequent step, it is possible for the bonding film 15 to reliably develop the bonding property.

In addition, it is preferred that each of the silicone compounds has at least one silanol group. Specifically, it is preferable to use silicone compounds each having a chemical structure represented by the above general formula (4) in which the Zs are the hydroxyl groups.

In the case where the bonding film 15 is formed using the silicone material composed of such silicone compounds, when drying the liquid material 31 (the liquid coating 32) to finally transform it into the bonding film 15 in the following step, the hydroxyl groups (included in the silanol groups) of the adjacent silicone compounds are bonded together. Therefore, the thus formed bonding film 15 can have more excellent film strength.

In addition, in the case where the substrate 20 described above, in which the hydroxyl groups are exposed on the bonding surface, is used, the hydroxyl groups (included in the silanol groups) of the silicone compounds and the hydroxyl groups present in the substrate 20 are bonded together.

As a result, the silicone compounds can be bonded to the bonding surface of the substrate 20 not only through physical bonds but also through chemical bonds. This makes it possible for the bonding film 15 to be firmly bonded to the bonding surface of the substrate 20.

Further, the silicone material is a material having relatively high flexibility. Therefore, even if the constituent material of the substrate 20 is different from that of the nozzle plate 10, when the head 1 is obtained by bonding them together through the bonding film 15 in the subsequent step, the bonding film 15 can reliably reduce stress which would be generated between the substrate 20 and the nozzle plate 10 due to thermal expansions thereof. As a result, it is possible to reliably prevent occurrence of peeling in the head 1 finally obtained.

Since the silicone material also has excellent chemical resistance, it can be effectively used in bonding parts (members), which are exposed to chemicals for a long period of time, together. Specifically, for example, the bonding film 15 can be used in manufacturing a liquid droplet ejection head of a commercial ink jet printer in which an organic ink being apt to erode a resin material is employed. This makes it possible to reliably improve durability of the liquid droplet ejection head.

In addition, since the silicone material has excellent heat resistance, it can also be effectively used in bonding parts (members), which are exposed to a high temperature, together.

The viscosity (at 25° C.) of the liquid material 31 is, generally, preferably in the range of about 0.5 to 200 mPa·s, and more preferably in the range of about 3 to 20 mPa·s. By adjusting the viscosity of the liquid material 31 to the range noted above, such a liquid material 31 can contain a sufficient amount of the silicone material therein. Therefore, by drying the liquid coating 32 formed of such a liquid material 31 in the following step, the bonding film 15 can be formed reliably.

As described above, although the liquid material 31 contains the silicone material, in the case where the silicone material itself is in the form of liquid and has a required viscosity range, the silicone material can be used as the liquid material 31 directly.

On the other hand, in the case where the silicone material 31 itself is in the form of solid or liquid having a high viscosity, a solution or dispersion liquid containing the silicone material can be used as the liquid material 31.

Examples of a solvent dissolving the silicone material or a dispersion medium for dispersing the same include: various kinds of inorganic solvents such as ammonia, water, hydrogen peroxide, carbon tetrachloride and ethylene carbonate; various kinds of organic solvents such as ketone-based solvents (e.g., methyl ethyl ketone (MEK) and acetone), alcohol-based solvents (e.g., methanol, ethanol and isopropanol), ether-based solvents (e.g., diethyl ether and diisopropyl ether), cellosolve-based solvents (e.g., methyl cellosolve), aliphatic hydrocarbon-based solvents (e.g., hexane and pentane), aromatic hydrocarbon-based solvents (e.g., toluene, xylene and benzene), aromatic heterocycle compound-based solvents (e.g., pyridine, pyrazine and furan), amide-based solvents (e.g., N,N-dimethylformamide), halogen compound-based solvents (dichloroethane and chloroform), ester-based solvents (e.g., ethyl acetate and methyl acetate), sulfur compound-based solvents (e.g., dimethyl sulfoxide (DMSO) and sulfolane), nitrile-based solvents (e.g., acetonitrile, propionitrile and acrylonitrile), organic acid-based solvents (e.g., formic acid and trifluoroacetic acid); mixture solvents each containing at least one kind of the above solvents; and the like.

Among these solvents, the solvent (or the dispersion medium) preferably contains at least one of the toluene and the xylene. These solvents have excellent resolvability to the silicone material. Use of these solvents makes it possible to obtain a homogeneous liquid material 31 in which the silicone material is uniformly dissolved.

Therefore, a liquid coating 32 formed by using such a liquid material 31 can become homogeneous. As a result, by drying the liquid coating 32, it is possible to obtain a bonding film 15 having an uniform thickness.

Further, since both the toluene and the xylene have superior volatilities at normal temperature and pressure, they can be easily vaporized for a short period of time in the subsequent drying step. Therefore, even in the case where a bonding film 15 having a large thickness is formed, it can be effectively obtained.

<15-2> Next, the liquid coating 32 is dried by leaving it or using an arbitrary drying treatment, to thereby obtain a dried body on the upper surface (the bonding surface) of the substrate 20. Such a dried body serves as the bonding film 15 which can develop the bonding property by applying the energy thereto (these steps <15-1> and <15-2> are the twelfth step).

In the case where the silicone material composed of the silicone compounds each having the at least one silanol group is used, the silanol groups of the adjacent silicone compounds can be reliably bonded together to thereby obtain a bonding film 15 having excellent film strength. In this case, such silanol groups also can be reliably bonded to the hydroxyl groups present in the substrate 20 so that the thus formed bonding film 15 are firmly bonded to the substrate 20.

Further, since the bonding film 15 contains the silicon material composed of the silicone compounds as a major component thereof, it can have low thermal expansion coefficient. Therefore, it is possible to suppress expansion and constriction of the bonding film 15 due to a temperature change thereof.

Specially, when bonding parts formed of a silicon material together through the bonding film 15, it is possible to suppress stress concentration which would be generated in bonding interfaces therebetween due to a difference between their thermal expansion coefficients.

For these reasons, according to the bonding film 15, the substrate 20 and the nozzle plate 10 can be reliably bonded together.

A drying temperature of the liquid coating 32 is preferably 25° C. or higher, and more preferably in the range of about 25 to 100° C. Further, a drying time of the liquid coating 32 is preferably in the range of about 0.5 to 48 hours, and more preferably in the range of about 15 to 30 hours.

An ambient pressure in drying the liquid coating 32 may be an atmospheric pressure, but is preferably a reduced pressure. Specifically, a degree of the reduced pressure is preferably in the range of about $133.3\times10^{-5}$ to 1,333 Pa ($1\times10^{-5}$ to 10 Torr), and more preferably in the range of about $133.3\times10^{-4}$ to 133.3 Pa ($1\times10^{-4}$ to 1 Torr).

This makes it possible to progress the drying of the liquid coating 32. This also makes it possible to improve density of the bonding film 15, that is, the bonding film 3 can become dense. As a result, the bonding film 3 can have more excellent film strength.

In this way, by appropriately controlling the conditions in forming the bonding film 15, it is possible to form a bonding film 15 having a desired film strength and the like.

An average thickness of the bonding film 15 is preferably in the range of about 10 to 10,000 nm, and more preferably in the range of about 50 to 5,000 nm. By setting the average thickness of the formed bonding film 15 to the above range, it is possible to prevent dimensional accuracy of the fifth bonded body obtained by bonding the substrate 20 and the nozzle plate 10 together from being significantly lowered, thereby enabling to more firmly bond them together.

In this regard, setting of the average thickness of the bonding film 15 can be performed by appropriately controlling an amount of the liquid material 31 to be supplied onto the bonding surface of the substrate 20.

In other words, if the average thickness of the bonding film 15 is lower than the above lower limit value, there is a case that the fifth bonded body having sufficient bonding strength between the substrate 20 and the nozzle plate 10 cannot be obtained. In contrast, if the average thickness of the bonding film 3 exceeds the above upper limit value, there is a fear that dimensional accuracy of the fifth bonded body is lowered significantly.

Moreover, by setting the average thickness of the bonding film 15 to the above range, the bonding film 15 can have a certain degree of elasticity. Therefore, when the substrate 20 and the nozzle plate 10 are bonded together, even if particles or the like adhere (exist) on the bonding surface (the lower surface in each of FIGS. 7M and 7N) of the nozzle plate 10 with which the bonding film 15 is to be made contact, the bonding film 15 can be bonded to the bonding surface reliably.

As a result, it is possible to reliably suppress or prevent reduction of the bonding strength between the bonding film 15 and the nozzle plate 10 and occurrence of peeling of the bonding film 15 from the bonding surface in the bonding interface therebetween, due to the existence of the particles.

Further, in the present invention, the bonding film 15 is formed by supplying the liquid material 31 onto the bonding surface of the substrate 20. Therefore, even if irregularities exist on the bonding surface, the bonding film 15 can be formed so as to assimilate the irregularities of the bonding surface, though it may be affected depending on sizes (heights) thereof. As a result, a surface of the bonding film 15 can be composed from a substantially flat surface.

<15-3> Next, the energy is applied to the bonding film 15.

When the energy is applied to the bonding film 15, a part of the molecular bonds of the silicone compounds present in the vicinity of the surface of the bonding film 15 are broken. As a result, the surface is activated due to breakage of the molecular bonds. Namely, the bonding property with respect to the nozzle plate 10 is developed in the vicinity of the surface of the bonding film 15.

The substrate 20 having the bonding film 15 in such a state can be firmly bonded to the nozzle plate 10 based on chemical bonds.

Here, in this specification, a state that the surface of the bonding film 15 is "activated" means: a state that a part of the molecular bonds of the silicone compounds present in the vicinity of the surface are broken as described above, e.g., a part of the methyl groups are broken and removed from the polydimethylsiloxane chemical structure, and a part of the silicon atoms are not terminated so that "dangling bonds (or uncoupled bonds)" are generated on the surface; a state that the silicon atoms having the dangling bonds (the unpaired electrons) are terminated by hydroxyl groups (OH groups) and the hydroxyl groups exist on the surface; and a state that the dangling bonds and the hydroxyl groups coexist on the surface.

The energy may be applied to the bonding film 15 by any method. Examples of the method include: a method in which an energy beam is irradiated on the bonding film 15; a method in which the bonding film 15 is heated; a method in which a compressive force (physical energy) is applied to the bonding film 15; a method in which the bonding film 15 is exposed to plasma (that is, plasma energy is applied to the bonding film 15); a method in which the bonding film 15 is exposed to an ozone gas (that is, chemical energy is applied to the bonding film 3); and the like.

This makes it possible to effectively activate the surface of the bonding film 15. This also makes it possible to prevent excessive breakage of the molecular bonds of the silicone compounds contained in the bonding film 15. Therefore, it is possible to prevent a property of the bonding film 15 from being lowered.

Among the above methods, in this embodiment, it is particularly preferred that the method in which the energy beam is irradiated on the bonding film 15 is used as the method in which the energy is applied to the bonding film 15. Since such a method can efficiently apply the energy to the bonding film 15 relatively easily, the method is suitably used as the method of applying the energy.

Examples of the energy beam include: a ray such as an ultraviolet ray or a laser beam; an electromagnetic wave such as a X ray or a y ray; a particle beam such as an electron beam or an ion beam; and combinations of two or more kinds of these energy beams.

Figure 6L:
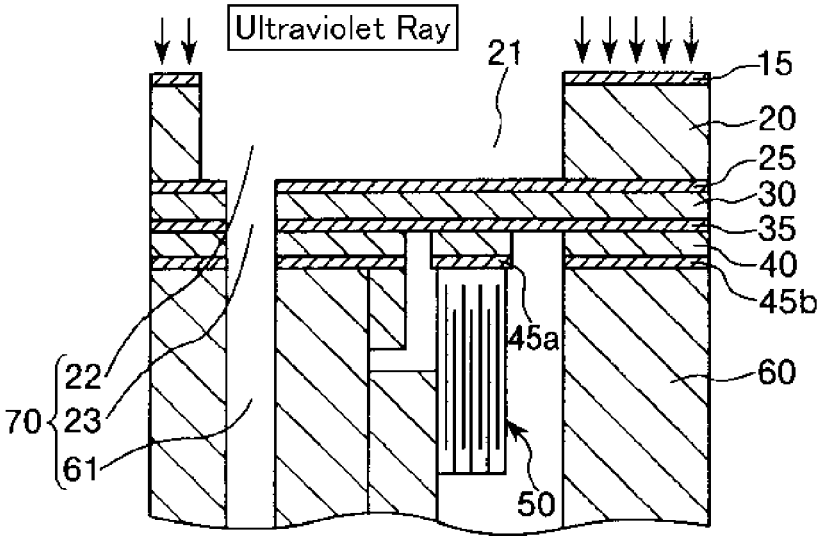

Among these energy beams, it is particularly preferred that an ultraviolet ray having a wavelength of about 126 to 300 nm is used (see FIG. 6L). Use of the ultraviolet ray having such a wavelength makes it possible to optimize an amount of the energy to be applied to the bonding film 15.

As a result, it is possible to prevent excessive breakage of the molecular bonds of the silicone compounds contained in the bonding film 15 as the major component thereof, and to selectively break the molecular bonds of the silicone compounds present in the vicinity of the surface of the bonding film 15. This makes it possible for the bonding film 15 to develop the bonding property, while preventing a property thereof such as a mechanical property or a chemical property from being lowered.

Further, the use of the ultraviolet ray makes it possible to process a wide area of the surface of the bonding film 15 without unevenness in a short period of time. Therefore, the breakage of the molecular bonds of the silicone compounds composing the silicone material contained in the bonding film 15 can be efficiently performed. Moreover, such an ultraviolet ray has, for example, an advantage that it can be generated by simple equipment such as an UV lamp.

In this regard, it is to be noted that the wavelength of the ultraviolet ray is more preferably in the range of about 126 to 200 nm.

In the case where the UV lamp is used, power of the UV lamp is preferably in the range about of 1 $mW/cm^2$ to 1 $W/cm^2$, and more preferably in the range of about 5 to 50 $mW/cm^2$, although being different depending on an area of the surface of the bonding film 15. In this case, a distance between the UV lamp and the bonding film 15 is preferably in the range of about 3 to 3,000 mm, and more preferably in the range of about 10 to 1,000 mm.

Further, a time for irradiating the ultraviolet ray is preferably set to a time enough for selectively breaking the molecular bonds of the silicone compounds present in the vicinity of the surface of the bonding film 15.

Specifically, the time is preferably in the range of about 1 second to 30 minutes, and more preferably in the range of about 1 second to 10 minutes, although being slightly different depending on an amount of the ultraviolet ray, the constituent material of the bonding film 15, and the like.

The ultraviolet ray may be irradiated temporally continuously or intermittently (in a pulse-like manner).

On the other hand, examples of the laser beam include: a pulse oscillation laser (a pulse laser) such as an excimer laser; a continuous oscillation laser such as a carbon dioxide laser or a semiconductor laser; and the like. Among these lasers, it is preferred that the pulse laser is used.

Use of the pulse laser makes it difficult to accumulate of heat in a portion of the bonding film 15 where the laser beam is irradiated with time. Therefore, it is possible to reliably prevent alteration and deterioration of the bonding film 15 due to the heat accumulated. Namely, according to the use of the pulse laser, it is possible to prevent affection of the heat accumulated inside the bonding film 15.

In the case where influence of the heat is taken into account, it is preferred that a pulse width of the pulse laser is as small as possible. Specifically, the pulse width is preferably equal to or smaller than 1 ps (picosecond), and more preferably equal to or smaller than 500 fs (femtoseconds).

By setting the pulse width to the above range, it is possible to reliably suppress the influence of the heat generated in the bonding film 15 due to the irradiation with the laser beam. In this regard, it is to be noted that the pulse laser having the small pulse width of the above range is called "femtosecond laser".

A wavelength of the laser beam is not particularly limited to a specific value, but is preferably in the range of about 200 to 1,200 nm, and more preferably in the range of about 400 to 1,000 nm. Further, in the case of the pulse laser, peak power of the laser beam is preferably in the range of about 0.1 to 10 W, and more preferably in the range of about 1 to 5 W, although being different depending on the pulse width thereof.

Moreover, a repetitive frequency of the pulse laser is preferably in the range of about 0.1 to 100 kHz, and more preferably in the range of about 1 to 10 kHz. By setting the frequency of the pulse laser to the above range, the molecular bonds of the silicone compounds present in the vicinity of the surface can be selectively broken.

By appropriately setting various conditions for such a laser beam, the temperature in the portion where the laser beam is irradiated is adjusted so as to be preferably in the range of about normal temperature (room temperature) to 600° C., more preferably about in the range of 200 to 600° C., and even more preferably in the range of about 300 to 400° C. The adjustment of the temperature in the region to the above range makes it possible to selectively break the molecular bonds of the silicone compounds present in the vicinity of the surface of the bonding film 15.

The laser beam irradiated on the bonding film 15 is preferably scanned along the surface of the bonding film 15 with a focus thereof set on the surface. By doing so, heat generated by the irradiation of the laser beam is locally accumulated in the vicinity of the surface. As a result, it is possible to selectively break the molecular bonds of the silicone compounds present in the vicinity of the surface of the bonding film 15.

Further, the irradiation of the energy beam on the bonding film 15 may be performed in any ambient atmosphere. Specifically, examples of the ambient atmosphere include: an oxidizing gas atmosphere such as air or an oxygen gas; a reducing gas atmosphere such as a hydrogen gas; an inert gas atmosphere such as a nitrogen gas or an argon gas; a decompressed (vacuum) atmospheres obtained by decompressing any one of these ambient atmospheres; and the like.

Among these ambient atmospheres, the irradiation is particularly preferably performed in the air atmosphere (particularly, an atmosphere having a low dew point). By doing so, it is possible to generate an ozone gas near the surface of the bonding film 15. This makes it possible to more smoothly activate the surface. Further, by doing so, it becomes unnecessary to spend a labor hour and a cost for controlling the ambient atmosphere. This makes it possible to easily perform (carry out) the irradiation of the energy beam.

In this way, according to the method of irradiating the energy beam, the energy can be easily applied to the bonding film 15 selectively. Therefore, it is possible to prevent, for example, alteration and deterioration of the substrate 20 due to the application of the energy.

Further, according to the method of irradiating the energy beam, magnitude of the energy to be applied can be accurately and easily controlled. Therefore, it is possible to adjust the number of the molecular bonds to be broken within the bonding film 15. By adjusting the number of the molecular bonds to be broken in this way, it is possible to easily control the bonding strength between the substrate 20 and the nozzle plate 10.

In other words, by increasing the number of the molecular bonds to be broken in the vicinity of the surface of the bonding film 15, since a large number of active hands are generated in the vicinity of the surface, it is possible to further improve the bonding property developed in the bonding film 15.

On the other hand, by reducing the number of the molecular bonds to be broken in the vicinity of the surface of the bonding film 15, it is possible to reduce the number of the active hands generated in the vicinity of the surface, thereby suppressing the bonding property developed in the bonding film 15.

In order to adjust the magnitude of the applied energy, for example, conditions such as a kind of the energy beam, power of the energy beam, and an irradiation time of the energy beam only have to be controlled.

Further, according to the method of irradiating the energy beam, a large amount of the energy can be applied to the bonding film 15 for a short period of time. This makes it possible to more effectively perform the application of the energy.

Figure 7M:
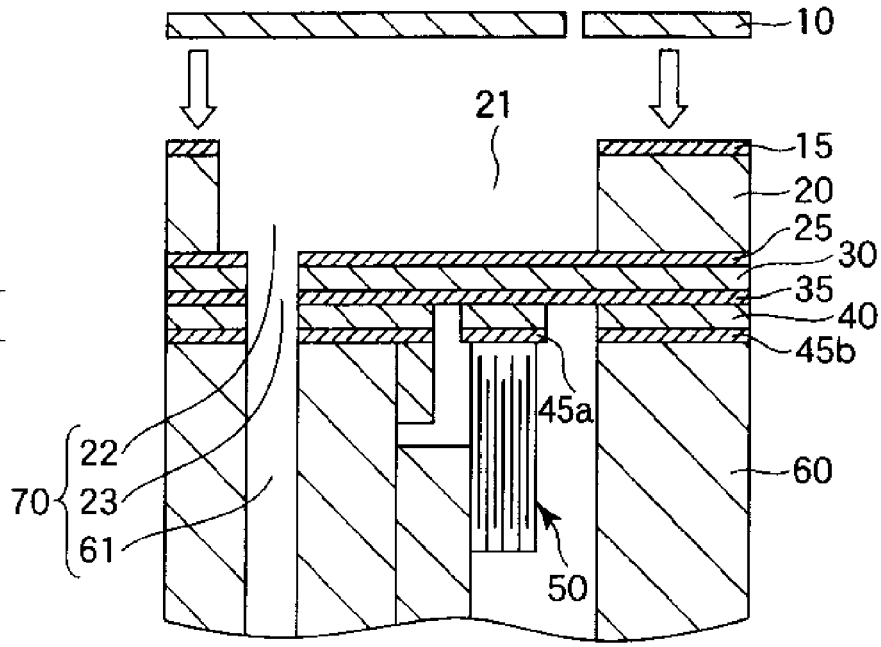
FIGS. 7M and 7N are views (vertical section views continued from FIG. 6L) for describing a method of producing the ink jet type recording head shown in FIGS. 1 and 2.

<15-4> Next, the nozzle plate 10 is prepared. As shown in FIG. 7M, the substrate 20 (the fourth bonded body) and the nozzle plate 10 are laminated together so that the bonding film 15 and the nozzle plate 10 make close contact with each other. At this time, since the surface of the bonding film 15 has developed the bonding property with respect to the nozzle plate 10 in the step <15-3>, the bonding film 15 and the nozzle plate 10 are chemically bonded together.

Figure 7N:
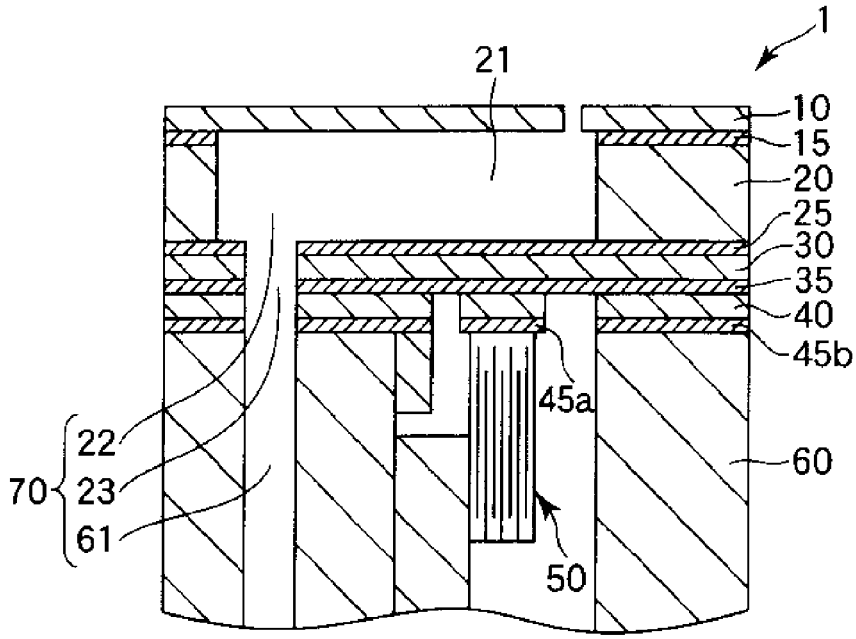

As a result, the substrate 20 and the nozzle plate 10 are bonded together through the bonding film 15, to thereby obtain a head 1 (that is, the fifth bonded body) shown in FIG. 7N (these steps <15-3> and <15-4> are the thirteenth step).

It is preferred that the coefficient of thermal expansion of the substrate 20 is substantially equal to that of the nozzle plate 10. If the coefficient of thermal expansion of the substrate 20 is substantially equal to that of the nozzle plate 10, it becomes difficult that stress in the bonding interface between the substrate 20 (the bonding film 15) and the nozzle plate 10 occurs when they are bonded together. As a result, it is possible to reliably prevent defects such as peeling from occurring in the finally obtained head 1.

Further, even if the coefficient of thermal expansion of the substrate 20 is different from that of the nozzle plate 10, it is possible to firmly bond the substrate 20 and the nozzle plate 10 together through the bonding film 15 in high dimensional accuracy by optimizing the following conditions when the nozzle plate 10 is bonded to the substrate 20.

That is to say, in the case where the coefficient of thermal expansion of the substrate 20 is different from that of the nozzle plate 10, it is preferred that the nozzle plate 10 is bonded to the substrate 20 at a temperature as low as possible. By bonding the substrate 20 and the nozzle plate 10 at the low temperature, it is possible to further reduce thermal stress which would be generated in the bonding interface between the substrate 20 (the bonding film 15) and the nozzle plate 10.

Specifically, the substrate 20 and the nozzle plate 10 are bonded together in a state that each of the substrate 20 and the nozzle plate 10 is heated preferably at a temperature in the range of about 25 to 50° C., and more preferably at a temperature in the range of about 25 to 40° C., although being different depending on the difference between the thermal expansion coefficients thereof.

In such a temperature range, even if the difference between the thermal expansion coefficients of the substrate 20 and the nozzle plate 10 is relatively large, it is possible to sufficiently reduce thermal stress which would be generated in the bonding interface between the substrate 20 (the bonding film 15) and the nozzle plate 10. As a result, it is possible to reliably suppress or prevent occurrence of warp, peeling or the like in the head 1.

Especially, in the case where the difference between the thermal expansion coefficients of the substrate 20 and the nozzle plate 10 is equal to or larger than $5\times10^{-5}$/K, it is particularly recommended that the substrate 20 and the nozzle plate 10 are bonded at a temperature as low as possible as described above.

In this regard, the nozzle plate 10 can be firmly bonded to the substrate 20 at the low temperature described above by using the bonding film 15.

Further, it is preferred that the substrate 20 and the nozzle plate 10 have a difference in their rigidities. This makes it possible to more firmly bond the substrate 20 and the nozzle plate 10 together.

In this embodiment, as described in the above step <15-3> and this step <15-4>, after the energy has been applied to the bonding film 15 to develop the bonding property in the vicinity of the surface of the bonding film 15, the substrate 20 and the nozzle plate 10 are laminated and bonded together through the bonding film 15.

However, the head 1 (the fifth bonded body) may be obtained by laminating the substrate 20 and the nozzle plate 10 together through the bonding film 15, and then applying the energy to the bonding film 15. Namely, the head 1 may be obtained by reversing the order of the above step <15-3> and this step <15-4>. Even if these steps <15-3> and <15-4> are performed in such an order, the same effects as described above can be obtained.

Here, description will be made on a mechanism that the substrate 20 and the nozzle plate 10 are bonded together in this process. Hereinafter, description will be representatively offered regarding a case that the hydroxyl groups are exposed in the region of the nozzle plate 10 to which the substrate 20 is to be bonded.

In this process, when the substrate 20 and the nozzle 10 are laminated together so that the bonding film 15 makes contact with the nozzle plate 10, the hydroxyl groups existing on the surface of the bonding film 15 and the hydroxyl groups existing on the region of the nozzle plate 10 are attracted together, as a result of which hydrogen bonds are generated between the above adjacent hydroxyl groups.

It is conceived that the generation of the hydrogen bonds makes it possible to bond the substrate 20 with the bonding film 15 and the nozzle plate 10 together.

Depending on conditions such as a temperature and the like, the hydroxyl groups bonded together through the hydrogen bonds are dehydrated and condensed, so that the hydroxyl groups and/or water molecules are removed from the bonding interface between the bonding film 15 and the nozzle plate 10. As a result, two atoms, to which the hydroxyl group had been bonded, are bonded together directly or via an oxygen atom. In this way, it is conceived that the substrate 20 and the nozzle plate 10 are firmly bonded together.

In addition, in the case where the dangling bonds (the uncoupled bonds) exist on the surface of the bonding film 15 and/or in the bonding film 15 or on the lower surface (the bonding surface) of the nozzle plate 10 and/or in the nozzle plate 10, when the substrate 20 and the nozzle plate 10 are laminated together, the dangling bonds are bonded together.

This bonding occurs in a complicated fashion so that the dangling bonds are inter-linked. As a result, network-like bonds are formed in the bonding interface. This makes it possible to particularly firmly bond the bonding film 15 and the nozzle plate 10 together.

In this regard, an activated state that the surface of the bonding film 15 is activated in the step <15-3> is reduced with the laps of time. Therefore, it is preferred that this step <15-4> is started as early as possible after the step <15-3>. Specifically, this step <15-4> is preferably started within 60 minutes, and more preferably started within 5 minutes after the step <15-3>.

If the step <15-4> is started within such a time, since the surface of the bonding film 15 maintains a sufficient activated state, when the nozzle plate 10 is bonded to the substrate 20 provided with the bonding film 15, they can be bonded together with sufficient high bonding strength therebetween.

In other words, the bonding film 15 before being activated is a film containing the silicone material as the major component thereof, and therefore it has relatively high chemical stability and excellent weather resistance. For this reason, the bonding film 15 before being activated can be stably stored for a long period of time. Therefore, a substrate 20 (a fourth bonded body) having such a bonding film 15 may be used as follows.

Namely, first, a large number of the substrates 20 (the fourth bonded bodies) each having such a bonding film 15 have been manufactured or purchased, and stored in advance. Then just before each of the substrates 20 and the nozzle plate 10 are laminated together through the bonding film 15 in this step, the energy is applied to only a necessary number of the substrates 20 (the fourth bonded bodies) each having such a bonding film 15 as described in the step <15-3>. This use is preferable because the heads 1 are manufactured effectively.

A bonding strength between the substrate 20 and the nozzle plate 10 is preferably equal to or larger than 5 MPa (50 kgf/cm$^2$) and more preferably equal to or larger than 10 MPa (100 kgf/cm$^2$). Therefore, such a bonding strength makes it possible to reliably prevent peeling of the substrate 20 and the nozzle plate 10. As a result, it is possible to obtain a head 1 having high reliability. By these steps described above, the head 1 can be produced.

Just when the head 1 is obtained or after the head 1 has been obtained, if necessary, at least one step (step of improving bonding strength between the respective parts of the head 1) of two steps (steps <16A> and <16B>) described below may be carried out to the head 1. This makes it possible to further improve the bonding strength between these parts, namely, the nozzle plate 10, the substrate 20, the sealing sheet 30, the vibration plate 40 and the case head 60 of the head 1.

<16A> The thus obtained head 1 is compressed in a direction that the nozzle plate 10, the substrate 20, the sealing sheet 30, the vibration plate 40 and the case head 60 approach to each other.

As a result, the surfaces of these parts come closer to the adjacent surfaces of the bonding film 15, 25, 35 and 45*b*. It is possible to further improve the bonding strength between the respective parts (e.g., between the substrate 20 and the nozzle plate 10, between the substrate 20 and the sealing sheet 30, between the sealing sheet 30 and the vibration plate 40, and between the case head 60 and the vibration plate 40) in the head 1.

Further, by compressing the head 1, spaces remaining in the bonding interfaces between the adjacent parts of the head 1 can be crashed so that bonding areas therebetween are increased. This makes it possible to further improve the bonding strength between the respective parts in the head 1.

In this regard, it is to be noted that a pressure in compressing the head 1 may be appropriately adjusted to a desired range, depending on the constituent materials and thicknesses of the parts of the head 1, conditions of a bonding apparatus, and the like.

Specifically, the pressure is preferably in the range of about 0.2 to 10 MPa, and more preferably in the range of about 1 to 5 MPa, although being slightly different depending on the constituent materials and thicknesses of the parts of the head 1 and the like.

By setting the pressure to the above range, it is possible to reliably improve the bonding strength between the respective parts in the head 1. Further, although the pressure may exceed the above upper limit value, there is a fear that damages and the like occur in each part of the head 1, depending on the constituent materials thereof.

A time for compressing the head 1 is not particularly limited to a specific value, but is preferably in the range of about 10 seconds to 30 minutes. The pressing time can be appropriately changed, depending on the pressure in compressing the head 1. Specifically, in the case where the pressure in pressing the head 1 is higher, it is possible to improve the bonding strength between the respective parts in the head 1 even if the pressing time becomes short.

<16B> In this step, the obtained head 1 is heated.

This makes it possible to improve the bonding strength between the respective parts in the head 1. A temperature in heating the head 1 is not particularly limited to a specific value, as long as the temperature is higher than room temperature and lower than a heat resistant temperature of the head 1.

Specifically, the temperature is preferably in the range of about 25 to 100° C., and more preferably in the range of about 50 to 100° C. If the head 1 is heated at the temperature of the above range, it is possible to reliably improve the bonding strength between the respective parts in the head 1 while reliably preventing them from being thermally altered and deteriorated.

Further, a heating time is not particularly limited to a specific value, but is preferably in the range of about 1 to 30 minutes.

In the case where both steps <16A> and <16B> are performed, the steps are preferably performed simultaneously. In other words, the head 1 is preferably heated while being compressed. By doing so, an effect by compressing and an effect by heating are exhibited synergistically. Therefore, it is possible to particularly improve the bonding strength between the respective parts in the head 1.

Through the steps as described above, it is possible to further improve the bonding strength between the respective parts in the head 1.

As described above, the description is made on the case that the nozzle plate 10 is laminated to the substrate 20 so that the bonding film 15 formed on the substrate 20 makes close contact with the nozzle plate 10 (see FIG. 7M).

However, the nozzle plate 10 may be laminated to the substrate 20 so that the bonding film 15 formed on the lower surface of the nozzle plate 10 makes close contact with the substrate 20. In this regard, as shown in FIG. 8, the bonding films 15 may be, respectively, formed on the upper surface (a lower surface in FIG. 8) of the substrate 20 and the lower surface (an upper surface in FIG. 8) of the nozzle plate 10.

Figure 8:
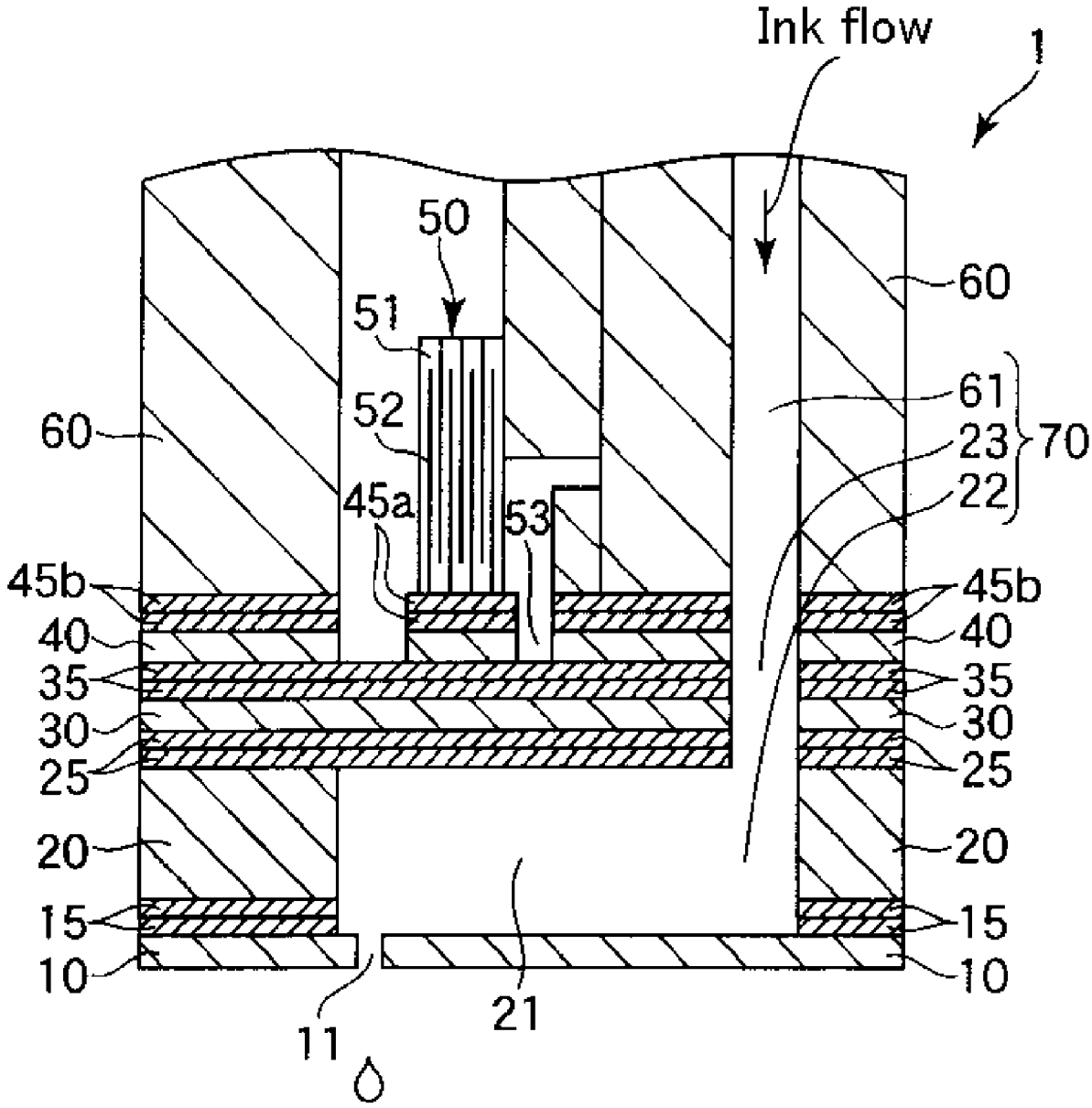
FIG. 8 is a vertical section view showing another configuration example of the ink jet type recording head according to the first embodiment.

FIG. 8 is a vertical section view showing another configuration example of the ink jet type recording head according to the first embodiment. In the following description, the upper side in FIG. 8 will be referred to as "upper" and the lower side thereof will be referred to as "lower" for convenience of explanation.

Hereinafter, this configuration example of the ink jet type recording head will be described by placing emphasis on the points differing from the above mentioned configuration example of the ink jet type recording head, with the same matters omitted from description.

This configuration example of the ink jet type recording head is the same as the above mentioned configuration example of the ink jet type recording head, except that structures of the first, second, third, fourth and fifth bonded portions are different from those of the above mentioned configuration example.

Namely, in the ink jet type recording head 1 (hereinafter, simply referred to as "head 1") shown in FIG. 8, each of the first, second, third, fourth and fifth bonded portions is formed from two bonding films.

Specifically, the substrate 20 and the nozzle plate 10 are laminated together so that the bonding film 15 formed on the lower surface of the substrate 20 and the bonding film 15 formed on the upper surface of the nozzle plate 10 make close contact with each other. In this way, the substrate 20 and the nozzle plate 10 are bonded together through the two bonding films 15.

Likewise, in the head 1 shown in FIG. 8, the substrate 20 and the sealing sheet 30 are laminated together so that the bonding film 25 formed on the upper surface of the substrate 20 and the bonding film 25 formed on the lower surface of the sealing sheet 30 make close contact with each other. In this way, the substrate 20 and the sealing sheet 30 are bonded together through the two bonding films 25.

Further, the sealing sheet 30 and the vibration plate 40 are laminated together so that the bonding film 35 formed on the upper surface of the sealing sheet 30 and the bonding film 35 formed on the lower surface of the vibration plate 40 make close contact with each other. In this way, the sealing sheet 30 and the vibration plate 40 are bonded together through the two bonding films 35.

Furthermore, the vibration plate 40 and the piezoelectric elements 50 are laminated together so that the bonding films 45*a* formed on a part of the upper surface of the vibration plate 40 and the bonding films 45*a* formed on the lower surfaces of the piezoelectric elements 50 make close contact with each other. In this way, the vibration plate 40 and the piezoelectric elements 50 are bonded together through the two bonding films 45*a*.

Moreover, the vibration plate 40 and the case head 60 is laminated together so that the bonding film 45*b* formed on the other part of the upper surface of the vibration plate 40 and the bonding film 45*b* formed on the lower surface of the case head 60 make close contact with each other. In this way, the vibration plate 40 and the case head 60 are bonded together through the two bonding films 45*b*.

According to the head 1 having such a configuration, the respective parts of the head 1 (the nozzle plate 10, the substrate 20, sealing sheet 30, the vibration plate 40, the piezoelectric elements 50 and the case head 60) are bonded together the two bonding films. This makes it possible to particularly firmly bond the respective parts together.

Further, according to the head 1 having such a configuration, the bonding strength between the respective parts of the head 1 is difficult to be affected by the constituent materials thereof. Therefore, it is possible to firmly bond the respective parts together, and thereby obtain a head 1 having high reliability.

For example, in the case where the nozzle plate 10 and the substrate 20 are bonded together, the energy may be applied to both the bonding film 15 formed on the lower surface of the substrate 20 and the bonding film 15 formed on the upper surface of the nozzle plate 10.

Further, such a head 1 can be preferably used for ejecting the liquid material 31 used in the present invention.

As described above, the liquid material 31 often contains the silicone material and the solvent (or the dispersion medium) in which the silicone material is dissolved or dispersed. There is a fear that such a solvent alterates or deteriorates a resin material. Therefore, an adhesive agent which makes contact with the liquid material 31 cannot maintain adhesiveness for a long period of time.

For this reason, in the case where the liquid material 31 is ejected using a conventional liquid droplet ejection head, there is a problem in that an adhesive agent, by which respective parts thereof are bonded together, is alterated or deteriorated so that the conventional liquid droplet ejection head cannot have high durability.

On the other hand, in the head 1 of this embodiment, since each of the bonded portions is formed from the bonding film having the chemical resistance, it is difficult to be alterated or deteriorated. Therefore, even in the case where the head 1 ejects the liquid material 31, it can exhibit excellent durability for a long period of time. In other words, the head 1 can be particularly preferably used for ejecting the liquid material 31.

As the silicone material 31, it is preferable to use the above mentioned material containing the silicone material and at least one of the toluene and the xylene as the solvent in which the silicone material is dissolved. However, since these preferable solvents have an abundance of an erosive property to a resin material, there is a problem in that durability of the conventional liquid droplet ejection head is reduced.

On the other hand, the head 1 of this embodiment can stably store and eject a liquid material, even if the liquid material contains the at least one of the toluene and the xylene each having high erosive property to the resin material. From this viewpoint, the head 1 is also particularly preferably used for ejecting the liquid material 31.

Second Embodiment

Next, a description will be made on a second embodiment of the case that the liquid droplet ejection head according to the present invention is used in an ink jet type recording head.

Figure 9:
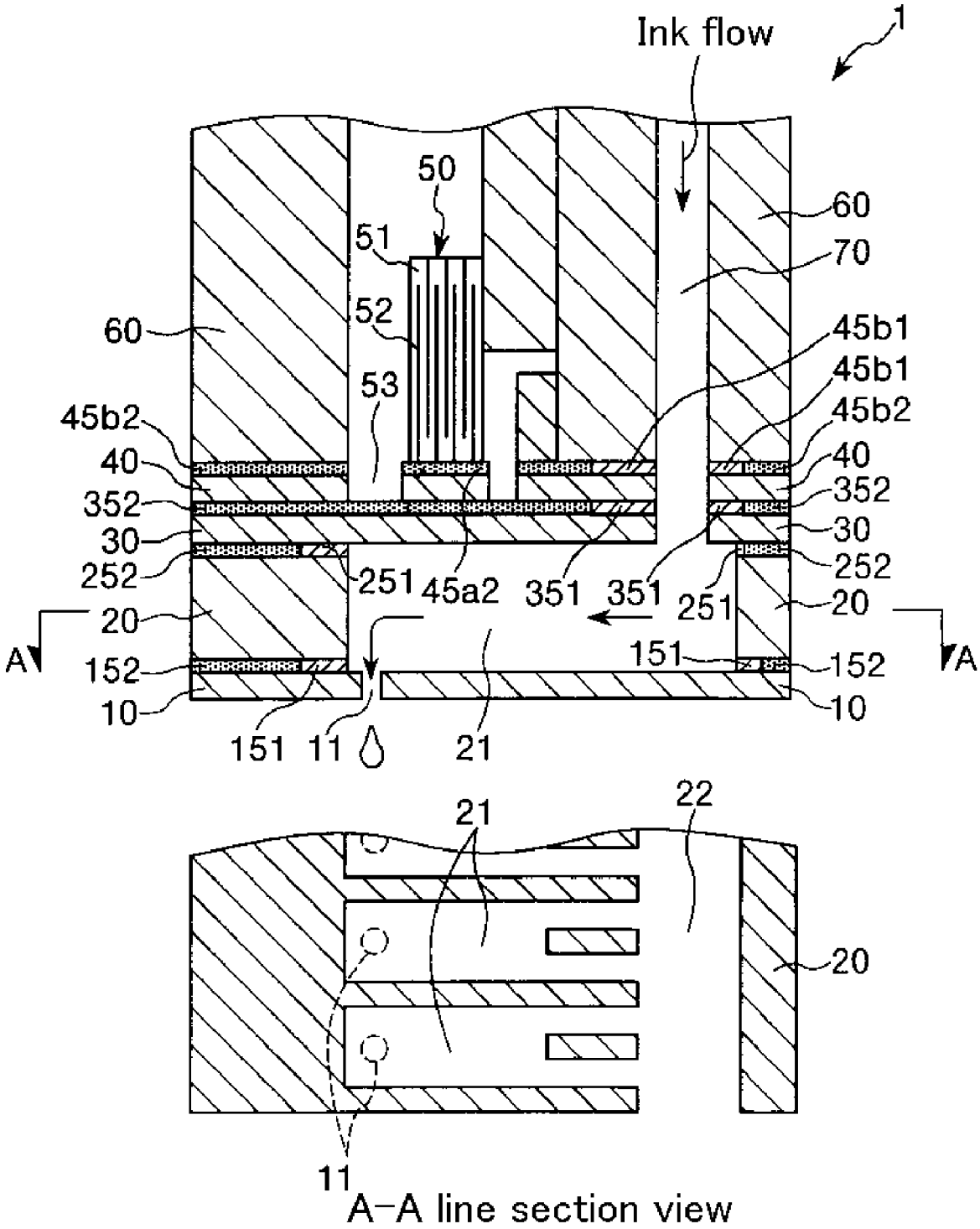
FIG. 9 is a vertical section view showing a second embodiment of an ink jet type recording head in which a liquid droplet ejection head according to the present invention is used.

FIG. 9 is a vertical section view showing a second embodiment of an ink jet type recording head in which a liquid droplet ejection head according to the present invention is used. In the following description, the upper side in FIG. 9 will be referred to as "upper" and the lower side thereof will be referred to as "lower" for convenience of explanation.

Hereinafter, the second embodiment of the ink jet type recording head will be described by placing emphasis on the points differing from the first embodiment of the ink jet type recording head, with the same matters omitted from description.

The second embodiment of the ink jet type recording head is the same as the first embodiment of the ink jet type recording head, except that structures of the first, second, third, fourth and fifth bonded portions are different from those of the first embodiment.

Namely, in the ink jet type recording head 1 (hereinafter, simply referred to as "head 1") shown in FIG. 9, each of the first, second, third and fifth bonded portions is formed from the bonding film and an adhesive film, and the fourth bonded portion is formed from adhesive films.

Specifically, like the first embodiment, the head 1 of the second embodiment also includes the nozzle plate 10, the substrate 20, the sealing sheet 30, the vibration plate 40, the piezoelectric elements 50 and the case head 60.

In this embodiment, the nozzle plate 10 and the substrate 20 are bonded together through a first bonded portion including a bonding film 151 having a bonding property developed and an adhesive film 152.

The bonding film 151 has the same composition as that of the bonding film 15 and provided on a side of the reservoir chambers 21 and the supply chamber 22. On the other hand, the adhesive film 152 is formed of an adhesive agent and provided on an opposite side of the bonding film 151 from the reservoir chambers 21 and the supply chamber 22.

The substrate 20 and the sealing sheet 30 are bonded together through a second bonded portion including a bonding film 251 having a bonding property developed and an adhesive film 252.

The bonding film 251 has the same composition as that of the bonding film 25 and provided on a side of the reservoir chambers 21 and the supply chamber 22. On the other hand, the adhesive film 252 is formed of an adhesive agent and provided on an opposite side of the bonding film 251 from the reservoir chambers 21 and the supply chamber 22.

The sealing sheet 30 and the vibration plate 40 are bonded together through a third bonded portion including a bonding film 351 having a bonding property developed and an adhesive film 352.

The bonding film 351 has the same composition as that of the bonding film 35 and provided on a side of the reservoir 70. On the other hand, the adhesive film 352 is formed of an adhesive agent and provided on an opposite side of the bonding film 351 from the reservoir 70.

The vibration plate 40 and the piezoelectric elements 50 are bonded together through a fourth bonded portion including a plurality of adhesive films **45*a*2** each formed of an adhesive agent.

The vibration plate 40 and the case head 60 are bonded together through a fifth bonded portion including a bonding film **45*b*1 having a bonding property developed and an adhesive film 45*b*2**.

The bonding film **45*b*1 has the same composition as that of the bonding film 45*b* and provided on a side of the reservoir 70. On the other hand, the adhesive film 45*b*2 is formed of an adhesive agent and provided on an opposite side of the bonding film 45*b*1 from the reservoir 70**.

In the head 1 having such a configuration, on the side of the reservoir chambers 21 and the supply chamber 22 or the reservoir 70 of the first, second, third and fifth bonded portions, the bonding films 151, 251, 351 and **45*b*1 each having the same composition as that of each of the bonding films 15, 25, 35 and 45*b*** of the first embodiment are provided.

Therefore, since the first, second, third and fifth bonded portions can exhibit excellent durability with respect to the ink and the like, the same operations and effects as those of the head 1 of the first embodiment can be obtained in the head 1 of the second embodiment.

Further, in the head 1 of this embodiment, on the opposite side of the bonding films 151, 251, 351 and **45*b*1 from the reservoir chambers 21 and the supply chamber 22 or the reservoir 70 of the first, second, third and fifth bonded portions, the adhesive films 152, 252, 352 and 45*b*2** each formed of the adhesive agent are provided.

Since the adhesive agent before being hardened or cured has a high viscosity, there is an advantage that it can be handled easily. Meanwhile, there is a disadvantage that it has inferior durability with respect to the ink.

On the other hand, in the head 1 of this embodiment, since the adhesive films 152, 252, 352, 45*a*2 and 45*b*2 do not make contact with the ink, they are not alterated or deteriorated by the ink. Further, since the adhesive agent constituting the adhesive films 152, 252, 352, 45*a*2 and 45*b*2 before being hardened or cured has the high viscosity, it can provisionally bond the respective parts of the head 1 together in a reliable manner.

In the head 1 of this embodiment, each of the first, second, third and fifth bonded portions is obtained by forming a partial region thereof from the adhesive film, and then forming the other region than the partial region from the bonding film having the bonding property developed. Use of such a method makes it possible to effectively produce the head 1 with ease.

Hereinafter, a method of producing the head 1 of this embodiment will be described.

<1> First, the nozzle plate 10, the substrate 20, the sealing sheet 30, the vibration plate 40, the piezoelectric elements 50 and the case head 60 are prepared.

Then, the nozzle plate 10, the substrate 20, the sealing sheet 30, the vibration plate 40 and the case head 60 are provisionally bonded together along edge portions thereof, that is, on a side of portions which do not expose to the ink using the adhesive agent. Further, the piezoelectric elements 50 are bonded to the vibration plate 40 using the adhesive agent. In this way, the above mentioned adhesive films 152, 252, 352, 45*a*2 and 45*b*2 are obtained.

At this time, a gap having a size corresponding to a thickness of the adhesive film 152 is formed between the nozzle plate 10 and the substrate 20, a gap having a size corresponding to a thickness of the adhesive film 252 is formed between the substrate 20 and the sealing sheet 30, a gap having a size corresponding to a thickness of the adhesive film 352 is formed between the sealing sheet 30 and the vibration plate 40, and a gap having a size corresponding to a thickness of the adhesive film 45*b*2 is formed between the vibration plate 40 and the case head 60.

As the adhesive agent, various kinds of adhesive agents such as an epoxy-based adhesive agent, an urethane-based adhesive agent and a silicone-based adhesive agent can be used.

<2> The liquid material 31 is supplied into the reservoir 70, the reservoir chambers 21 and the supply chamber 22 of the head 1 in which the nozzle plate 10, the substrate 20, the sealing sheet 30, the vibration plate 40 and the case head 60 are provisionally bonded together, and the piezoelectric elements 50 are bonded to the vibration plate 40.

By doing so, the liquid material 31 penetrates and fills into the respective gaps. This penetration phenomenon occurs based on a capillary phenomenon. Therefore, by merely supplying the liquid material 31 into the reservoir 70, the reservoir chambers 21 and the supply chamber 22, the respective gaps can be easily and reliably filled with the liquid material 31.

In this regard, in the case where a size (a height) of each of the gaps is smaller, a driving force of the capillary phenomenon becomes large. Therefore, it is preferred that the thickness of each of the adhesive films 152, 252, 352 and 45*b*2 is as small as possible.

<3> Next, an unnecessary liquid material 31 is removed from the reservoir 70, the reservoir chambers 21 and the supply chamber 22. Thereafter, the liquid material 31 filled (remained) into the respective gaps is dried to thereby obtain the above mentioned bonding films 151, 251, 351 and 45*b*1.

<4> Next, the energy is applied to the bonding films 151, 251, 351 and 45*b*1 so that the bonding property is developed therein. As a result, the first, second, third and fifth bonded portions are formed to thereby bond the respective parts of the head 1 together.

Through the steps <1> to <4>, the head 1 of this embodiment is completed.

In this way, since the plurality of the bonding films 151, 251, 351 and 45*b*1 are formed at the same time, it is possible to produce such a head 1 having excellent durability with respect to the ink in the production process simplified extensively.

Further, in the case where the liquid material 31 is used as the ejection liquid, during use of the head 1, the liquid material 31 makes contact with the bonding films 151, 251, 351 and 45*b*1 constantly. For this reason, even if defects such as peelings and cracks occur in the bonding films 151, 251, 351 and 45*b*1, the liquid material 31 can rapidly penetrate into the defects. Therefore, by routinely subjecting the head 1 in such a state to the treatment described in the above steps <3> and <4>, the head 1 can be restored easily.

In this regard, it is to be noted that at least one of the adhesive films 152, 252, 352, 45*a*2 and 45*b*2 may be replaced with the other film than the adhesive film. Examples of the other film include a plasma polymerization film, a CVD film, a PVD film and the like.

Although the liquid droplet ejection head and the liquid droplet ejection apparatus according to the present invention have been described above based on the embodiments illustrated in the drawings, the present invention is not limited thereto.

A method of producing the liquid droplet ejection head according to the present invention is not limited to above embodiments, and the steps may not be carried out in the order as described above. Further, one or more arbitrary steps may be added in the method, and unnecessary steps may be omitted.

EXAMPLES

Next, a description will be made on concrete examples of the present invention.

1. Production of Ink jet type Recording Head

Example 1

<1> First, a nozzle plate made of stainless steel, a plate-shaped base material made of monocrystalline silicon, a sealing sheet made of polyphenylenesulfide resin (PPS), a vibration plate made of stainless steel, piezoelectric elements each constituted from a laminated body including piezoelectric layers each formed from a sintered body of lead zirconate and electrical films each formed by sintering an Ag paste, and a case head made of PPS were prepared. Then, the base material was subjected to a surface treatment using oxygen plasma.

Next, a liquid material having a viscosity of 18.0 mPa·s at 25° C. ("KR-251" produced by Shin-Etsu Chemical Co., Ltd.) was prepared. In this regard, the liquid material contained a silicone material composed of silicone compounds each having a polydimethylsiloxane chemical structure, and toluene and isobutanol as a solvent.

Then, the liquid material was supplied onto a surface of the base material using an ink jet method, to form a liquid coating on the surface of the base material.

Next, the liquid coating was dried at normal temperature (25° C.) for 24 hours, to thereby obtain a bonding film having an average thickness of about 10 μm. Then, an ultraviolet ray was irradiated on the thus obtained bonding film under the following conditions.

Ultraviolet Ray Irradiation Conditions

Composition of atmospheric gas: air atmosphere

Temperature of atmospheric gas: 20° C.

Pressure of atmospheric gas: atmospheric pressure (100 kPa)

Wavelength of ultraviolet ray: 172 nm

Irradiation time of ultraviolet ray: 5 minutes

On the other hand, one surface of the sealing sheet was subjected to a surface treatment using oxygen plasma. Next, the base material and the sealing sheet were laminated together so that the ultraviolet ray-irradiated surface of the bonding film and the surface-treated surface of the sealing sheet made contact with each other.

In this way, a first bonded body in which the base material and the sealing sheet were bonded together through the bonding film (that is, the second bonded portion) was obtained.

<2> Next, a bonding film was formed on the other surface of the sealing sheet of the first bonded body in the same manner as in the above step <1>. Then, an ultraviolet ray was irradiated to a surface of the thus obtained bonding film. On the other hand, one surface of the vibration plate was subjected to a surface treatment using oxygen plasma.

Next, the first bonded body and the vibration plate were laminated together so that the ultraviolet ray-irradiated surface of the bonding film and the surface-treated surface of the vibration plate made contact with each other.

In this way, a second bonded body in which the base material, the sealing sheet and the vibration plate were bonded together through the bonding films (that is, the second and third bonded portions) was obtained.

<3> Next, a concave portion, which would be changed into a through-hole, was formed in a partial region of the second bonded body corresponding to a supply chamber to be formed. The concave portion passed through the sealing sheet, the vibration plate and the bonding films (the second and third bonded portions) and reached the base material.

Further, concave portions were formed in annular regions each surrounding a region of the vibration plate on which each of piezoelectric elements is provided. Each of the concave portions passed through the vibration plate and reached the bonding film (the third bonded portion) which was provided on the sealing sheet.

In this regard, it is to be noted that these concave portions were formed using an etching method.

<4> Next, bonding films were formed on surfaces of the regions of the vibration plate of the second bonded body on which the piezoelectric elements would be provided (that is, the regions each located inside the annular concave portion) in the same manner as in the above step <1>.

Then, an ultraviolet ray was irradiated on surfaces of the thus obtained bonding films in the same manner as in the above step <1>. On the other hand, one surface each of the piezoelectric elements was subjected to a surface treatment using oxygen plasma.

Next, the second bonding body and the piezoelectric elements were laminated together so that the ultraviolet ray-irradiated surface of each of the bonding films and the surface-treated surface of each of the piezoelectric elements made contact with each other.

In this way, a third bonded body in which the base material, the sealing sheet, the vibration plate and the piezoelectric elements were bonded together through the bonding films (that is, the second, third and fourth bonded portions) was obtained.

<5> Next, a bonding film was formed on a surface of a region of the vibration plate of the third bonded body to which the case head would be bonded in the same manner as in the above step <1>.

Then, an ultraviolet ray was irradiated on a surface of the thus obtained boning film in the same manner as in the above step <1>. On the other hand, a bonding surface of the case head was subjected to a surface treatment using oxygen plasma.

Next, the third bonding body and the case head were laminated together so that the ultraviolet ray-irradiated surface of the bonding film and the surface-treated bonding surface of the case head made contact with each other.

In this way, a fourth bonded body in which the base material, the sealing sheet, the vibration plate, the piezoelectric elements and the case head were bonded together through the bonding films (that is, the second, third, fourth and fifth bonded portions) was obtained.

<6> Next, the obtained fourth bonded body was turn over. Then, an opposite surface of the base material from the sealing sheet was processed using an etching method to thereby form a concave portion, which would be changed into reservoir chambers and supply chamber. The concave portion passed through the base material and reached the bonding film (that is, the second bonded portion).

In this way, a substrate for forming reservoir chambers was obtained by forming the concave portion (that is, first through-holes which would serve as the reservoir chambers and a second through-hole which would serve as the supply chamber) in the base material.

<7> Next, a bonding film was formed on a surface of the substrate for forming reservoir chambers in the same manner as in the above step <1>.

Then, an ultraviolet ray was irradiated on a surface of the thus obtained bonding film in the same manner as in the above step <1>. On the other hand, a bonding surface of the nozzle plate was subjected to a surface treatment using oxygen plasma.

Next, the substrate for forming reservoir chambers (that is, the fourth bonded body) and the nozzle plate were laminated together so that the ultraviolet ray-irradiated surface of the bonding film and the surface-treated bonding surface of the nozzle plate made contact with each other.

In this way, a fifth bonded body in which the nozzle plate, the substrate for forming reservoir chambers, the sealing sheet, the vibration plate, the piezoelectric elements and the case head were bonded together through the bonding films (that is, the first, second, third, fourth and fifth bonded portions) was obtained, namely, an ink jet type recording head was obtained.

<8> Next, the thus obtained ink jet type recording head was compressed at a pressure of 3 MPa for 15 minutes while heating at a temperature of 80° C. By doing so, bonding strength between the respective parts (that is, the nozzle plate, the substrate for forming reservoir chambers, the sealing sheet, the vibration plate, the piezoelectric elements and the case head) in the ink jet type recording head was improved.

Example 2

An ink jet type recording head was produced in the same manner as in the Example 1 except that the bonding films were formed on both surfaces of the base material, both surfaces of the sealing sheet and both surfaces of the vibration plate, and the respective parts (the nozzle plate, the base material, the sealing sheet, the vibration plate, the piezoelectric elements and the case head) are bonded together through the two bonding films.

Specifically, first, a bonding film was formed on the surface of the base material in the same manner as in the Example 1. Then, the bonding film was also formed on the one surface of the sealing sheet in the same manner as in the Example 1.

Next, the ultraviolet ray was irradiated to both the bonding film formed on the surface of the base material and the bonding film formed on the one surface of the sealing sheet. Next, the base material and the sealing sheet were laminated together so that the two bonding films made close contact with each other to thereby bond the base material and the sealing sheet together through the two bonding films.

Likewise, the sealing sheet and the vibration plate, the vibration plate and the piezoelectric elements, the vibration plate and the case head, and the substrate for forming reservoir chambers and the nozzle plate were bonded together through the two bonding films, respectively.

Example 3

An ink jet type recording head shown in FIG. 9 was produced according to the method described in the above second embodiment. In this regard, it is to be noted that the bonding films 151, 251, 351 and 45*b*1 shown in FIG. 9 were formed in the same manner as in the Example 1, whereas the adhesive films 152, 252, 352, 45*a*2 and 45*b*2 shown in FIG. 9 were formed using an epoxy-based adhesive agent.

Comparative Example

An ink jet type recording head was produced in the same manner as in the Example 1 except that all bonded portions (that is, the first, second, third, fourth and fifth bonded portions) were formed using an epoxy-based adhesive agent, namely, the nozzle plate and the base material, the base material and the sealing sheet, the sealing sheet and the vibration plate, the vibration plate and the piezoelectric elements, and the vibration plate and the case head were bonded together using the epoxy-based adhesive agent, respectively.

2. Evaluation of Ink Jet Type Recording Head 2.1 Evaluation of Dimensional Accuracy Dimensional accuracy was measured for each of the ink jet type recording heads obtained in the Examples 1 to 3 and the Comparative Example.

As a result, the dimensional accuracy of each of the ink jet type recording heads obtained in the Examples 1 to 3 were higher than the dimensional accuracy of the ink jet type recording head obtained in the Comparative Example.

Further, ink jet printers were produced by mounting the ink jet type recording heads obtained in the Examples 1 to 3 and the Comparative Example. Then, print sheets were printed by each of the ink jet printers.

As a result, each of the ink jet printers produced by mounting the ink jet type recording heads obtained in the Examples 1 to 3 exhibited superior print quality as compared to the ink jet printer produced by mounting the ink jet type recording head obtained in the Comparative Example.

2.2 Evaluation of Chemical Resistance

A liquid material having a viscosity of 18.0 mPa·s at 25° C. ("KR-251" produced by Shin-Etsu Chemical Co., Ltd.) was filled into each of the ink jet type recording heads obtained in the Examples 1 to 3 and the Comparative Example and left for three weeks. In this regard, it is to be noted that the liquid material contained toluene and isobutanol as a solvent.

Thereafter, a state of each of the ink jet type recording heads was observed. Then, it was checked whether the ink penetrated into the bonded portions (the bonding films) provided in the ink jet type recording head or not. The results of the check were evaluated.

As a result, in each of the ink jet type recording heads obtained in the Examples 1 to 3, the ink hardly penetrated into each bonded portions (in particular, the bonding films). In contrast, in the ink jet type recording head obtained in the Comparative Example, the ink penetrated into each bonded portion.

What is claimed is:

1. A liquid droplet ejection head, comprising:

a substrate having first through-holes that serve as ejection liquid reservoir chambers for reserving an ejection liquid and a second through-hole that serves as an ejection liquid supply chamber for supplying the ejection liquid to the ejection liquid reservoir chambers, the substrate having one surface and the other surface opposite to the one surface;

a nozzle plate having nozzles that ejects the ejection liquid in the form of liquid droplets, the nozzle plate provided on a side of the one surface of the substrate so as to cover the first through-holes and the second through-hole of the substrate;

a sealing plate provided on a side of the other surface of the substrate so as to cover the first through-holes of the substrate;

a driving means that drives the liquid droplet ejection head to eject the ejection liquid from the nozzles;

a first bonded portion through which the substrate and the nozzle plate are bonded together; and a second bonded portion through which the substrate and the sealing plate are bonded together, wherein at least one of the first and second bonded portions includes a bonding film formed by drying a liquid coating formed of a liquid material containing a silicone material composed of silicone compounds, and wherein the bonding film bonds the substrate and at least one of the nozzle plate and the sealing plate together due to a bonding property developed in the bonding film by applying energy thereto.

2. The liquid droplet ejection head as claimed in claim 1, wherein a part of the at least one of the bonded portions is provisionally formed from an adhesive agent and the other part of the bonded portion is formed from the bonding film.

3. The liquid droplet ejection head as claimed in claim 2, wherein the first and second bonded portions are formed by the steps of:

provisionally bonding the substrate and the nozzle plate together along edge portions thereof using the adhesive agent so as to form a gap between the substrate and the nozzle plate, and the substrate and the sealing plate together along edge portions thereof using the adhesive agent so as to form a gap between the substrate and the sealing plate, respectively;

supplying the liquid material into the first through-holes and the second through-hole covered by the nozzle plate and the sealing plate so that the liquid material is filled into the gaps to obtain the liquid coatings within the gaps; and drying the liquid coatings to obtain the bonding films, wherein one of the bonding films bonds the substrate and the nozzle plate together and the other bonding film bonds the substrate and the sealing plate together due to the bonding property developed in each of the bonding films by applying the energy thereto.

4. The liquid droplet ejection head as claimed in claim 1, wherein each of the silicone compounds has a polydimethylsiloxane chemical structure as a main chemical structure thereof.

5. The liquid droplet ejection head as claimed in claim 1, wherein each of the silicone compounds has at least one silanol group.

6. The liquid droplet ejection head as claimed in claim 1, wherein an average thickness of the bonding film is in the range of 10 to 10,000 nm.

7. The liquid droplet ejection head as claimed in claim 1, wherein at least a portion of each of the substrate, the nozzle plate and the sealing plate which makes contact with the bonding film is composed of a silicon material, a metal material or a glass material as a major component thereof.

8. The liquid droplet ejection head as claimed in claim 1, wherein a surface of each of the substrate, the nozzle plate and the sealing plate which makes contact with the bonding film has been, in advance, subjected to a surface treatment for improving bonding strength between each of them and the bonding film.

9. The liquid droplet ejection head as claimed in claim 8, wherein the surface treatment is a plasma treatment or an ultraviolet ray irradiation treatment.

10. The liquid droplet ejection head as claimed in claim 1, wherein the application of the energy is performed by a method in which an energy beam is irradiated on the bonding film.

11. The liquid droplet ejection head as claimed in claim 10, wherein the energy beam is an ultraviolet ray having a wavelength of 126 to 300 nm.

12. The liquid droplet ejection head as claimed in claim 1, wherein the application of the energy is performed in an air atmosphere.

13. The liquid droplet ejection head as claimed in claim 1, wherein after the substrate and at least one of the nozzle plate and the sealing plate are bonded together through the at least one bonded portion including the bonding film, the bonding film is subjected to a treatment for improving bonding strength therebetween.

14. The liquid droplet ejection head as claimed in claim 13, wherein the treatment for improving bonding strength is performed by at least one method selected from the group comprising a method in which the bonding film is heated and a method in which a compressive force is applied to the bonding film.

15. The liquid droplet ejection head as claimed in claim 1, wherein the sealing plate is formed from a laminated body including a plurality of layers, and wherein two adjacent layers are bonded together through a bonding film having the same composition as that of the bonding film.

16. The liquid droplet ejection head as claimed in claim 1, wherein the driving means is a vibration means provided on an opposite side of the sealing plate from the substrate, the vibration means that vibrates the sealing plate, and wherein the vibration means and the sealing plate are bonded together through a bonding film having the same composition as that of the bonding film.

17. The liquid droplet ejection head as claimed in claim 16, wherein the vibration means comprises piezoelectric elements.

18. The liquid droplet ejection head as claimed in claim 1 further comprising a case head provided on an opposite side of the sealing plate from the substrate, wherein the sealing plate and the case head are bonded together through a bonding film having the same composition as that of the bonding film.

19. The liquid droplet ejection head as claimed in claim 1 being adapted to be used for ejecting a liquid material having the same composition as that of the liquid material as the ejection liquid.

20. The liquid droplet ejection head as claimed in claim 19, wherein the liquid material to be ejected from the nozzles contains at least one of toluene and xylene.

21. A liquid droplet ejection apparatus provided with the liquid droplet ejection head defined in claim 1.

* * * * *